US007394364B2

(12) United States Patent
Elliott

(10) Patent No.: US 7,394,364 B2
(45) Date of Patent: Jul. 1, 2008

(54) WIRELESS ITEM LOCATION MONITORING SYSTEM AND METHOD

(76) Inventor: Robert Odell Elliott, 3442 New Hartford Rd., Apt. No. 1, Owensboro, KY (US) 42303

( * ) Notice: Subject to any disclaimer, the term of this patent is extended or adjusted under 35 U.S.C. 154(b) by 222 days.

(21) Appl. No.: 11/211,362

(22) Filed: Aug. 25, 2005

(65) Prior Publication Data

US 2006/0044134 A1 Mar. 2, 2006

Related U.S. Application Data

(60) Provisional application No. 60/604,192, filed on Aug. 25, 2004.

(51) Int. Cl.
*G08B 1/08* (2006.01)

(52) U.S. Cl. ..... 340/539.23; 340/539.1; 340/539.13; 340/539.21; 340/573.1; 340/686.1; 340/7.1; 340/825.36

(58) Field of Classification Search ..... 340/539.23, 340/539.1, 539.13, 539.15, 539.21, 573.1, 340/686.1, 7.1, 7.21, 573.4, 825.36, 539.32; 455/524, 526

See application file for complete search history.

(56) References Cited

U.S. PATENT DOCUMENTS

| | | | | |
|---|---|---|---|---|
| 4,814,751 | A | 3/1989 | Hawkins et al. | 340/573 |
| 4,918,432 | A * | 4/1990 | Pauley et al. | 340/573.4 |
| 5,357,361 | A | 10/1994 | Nishizawa | 359/142 |
| 5,771,002 | A * | 6/1998 | Creek et al. | 340/539.21 |
| 6,046,674 | A | 4/2000 | Irwin et al. | 340/539 |
| 6,078,269 | A | 6/2000 | Markwell et al. | 340/825.5 |
| 6,297,734 | B1 | 10/2001 | Richardson et al. | 340/539 |
| 6,307,524 | B1 | 10/2001 | Britain | 343/795 |
| 6,784,787 | B1 | 8/2004 | Atkins et al. | 340/10.4 |
| 6,956,475 | B1 * | 10/2005 | Hill | 340/539.11 |
| 7,034,684 | B2 * | 4/2006 | Boman et al. | 340/568.1 |
| 7,034,690 | B2 * | 4/2006 | Chaco | 340/573.1 |
| 2002/0017988 | A1 | 2/2002 | Irwin | 340/539 |
| 2002/0021214 | A1 | 2/2002 | Carroll | 340/540 |
| 2002/0063627 | A1 | 5/2002 | Makiyama et al. | 340/573.4 |
| 2003/0142586 | A1 | 7/2003 | Shah et al. | 367/82 |
| 2004/0036597 | A1 | 2/2004 | Mays, Jr. et al. | 340/539.1 |
| 2004/0039521 | A1 | 2/2004 | Hathiram et al. | 701/207 |

* cited by examiner

*Primary Examiner*—Davetta W. Goins
(74) *Attorney, Agent, or Firm*—Guy V. Manning

(57) ABSTRACT

A wireless electronic tracking system employs transmitters attached to moveable target items that send continuous analog radio frequency (RF) digitally-coded signals at prime number differentiated time intervals to a base receiver. The coded signals carry transmitter and base unit identifiers, low battery and attachment status information. The base unit periodically scans using an omnidirectional antenna to determine distance and azimuth for multiple active transmitters, alerting an operator to any status alerts, such as 'out of range' status determined by signal strength. The operator can switch to a higher gain, directional antenna to search for an errant target transmitter, or simply to check on the whereabouts of any given target item. Because the movable target items need only transmit, the transmitters can be physically diminutive and unobtrusive to the target wearer, making the system practical for tracking people (e.g. geriatric or juvenile, for assistance or to deter leaving group members behind), animals (e.g. pets, livestock) and even inventory (e.g. especially expensive items that shouldn't move from a given spot in a retail setting).

22 Claims, 31 Drawing Sheets user interface flow diagram

Transmitter hardware block diagram receiver hardware block diagram receiver microcontroller hardware block diagram Interface between hardware and software - find mode checkbatt routine checkmissingperson interrupt routine Timer0 Interrupt button confirm Routine

WIRELESS ITEM LOCATION MONITORING SYSTEM AND METHOD

This application claims priority from a Provisional Application Ser. No. 60/604,193, filed Aug. 25, 2004.

BACKGROUND OF THE INVENTION

1. Field of the Invention

This invention relates generally to wireless monitoring systems and particularly to such systems adapted to monitor the location of movable items such as people, animals or merchandise. More particularly, this invention relates to a wireless transmitter attached to each item and a base station monitoring multiple items, providing out of range alarms and doubling as a finding device.

2. Description of Related Art

Geriatric patients often move about freely within the boundaries of a resident hospital, but some could endanger themselves and become lost and unable to find their way home if they wander outside the grounds. Likewise, pets straying too far from a home location sometimes get lost or stolen. Expensive retail merchandise susceptible to shoplifting can be spirited away and if small enough hidden in the thief's pocket or packages, thereby deterring thorough investigation based on suspicion alone. Horror stories abound of children or scuba divers on tours being left behind because an improper head count overlooked their absence.

Numerous prior art devices and systems provide means for monitoring the location and status of movable items, but most are too expensive and complex for practical use in many of the above circumstances. Systems designed for patients potentially needing immediate medical attention provide a base station and portable transceivers which trigger an alarm, either manually by a distressed patient or automatically by a sensor monitoring body functions such as breathing or pulse. The base unit then alerts help on the premises or contacts emergency response services such as police or paramedics to come to the patient's assistance. Such systems typically involve patient signaling options and transceiver functions in the patient-worn device and in the base unit, making them complex and expensive and reducing the applications in which they are practical.

Other less expensive perimeter monitoring systems rely on passive unit-carried devices which set off an alarm as the unit passes a perimeter sensor, like retail shoplifting detection systems, but which provide no distance and direction capabilities for finding missing units. A simple system which detects unit movement beyond a given perimeter or distance could find wide uses in diverse markets.

SUMMARY OF THE INVENTION

Accordingly, it is an object of this invention to provide means of tracking continuous care patients who remain ambulatory but may need immediate attention at any given time.

It is another object of this invention to provide means for tracking pets or livestock which may move about but should not leave a premises.

It is another object of this invention to provide economical means for monitoring the exact location of merchandise in a warehouse, retail or other setting.

It is another object of this invention to provide economical means for assuring head count in groups to avoid inadvertent omission of members when the group leaves.

It is yet another object of this invention to provide a diminutive transmitter unobtrusive to the wearer which can be tracked by a base unit.

The foregoing and other objects of this invention are achieved by providing a wireless electronic tracking system which employs transmitters attached to moveable target items that send continuous analog radio frequency (RE) digitally-coded signals at prime number differentiated time intervals to a base receiver. The coded signals carry transmitter and base unit identifiers, low battery and attachment status information. The base unit periodically scans using an omnidirectional antenna to determine distance and azimuth for multiple active transmitters, alerting an operator to any status alerts, such as 'out of range' status determined by signal strength. The operator can switch to a higher gain, directional antenna to search for an errant target transmitter, or simply to check on the whereabouts of any given target item. Because the movable target items need only transmit, the transmitters can be physically diminutive and unobtrusive to the target wearer, making the system practical for tracking people (e.g. geriatric or juvenile, for assistance or to deter leaving group members behind), animals (e.g. pets, livestock) and even inventory (e.g. especially expensive items that shouldn't move from a given spot in a retail setting).

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
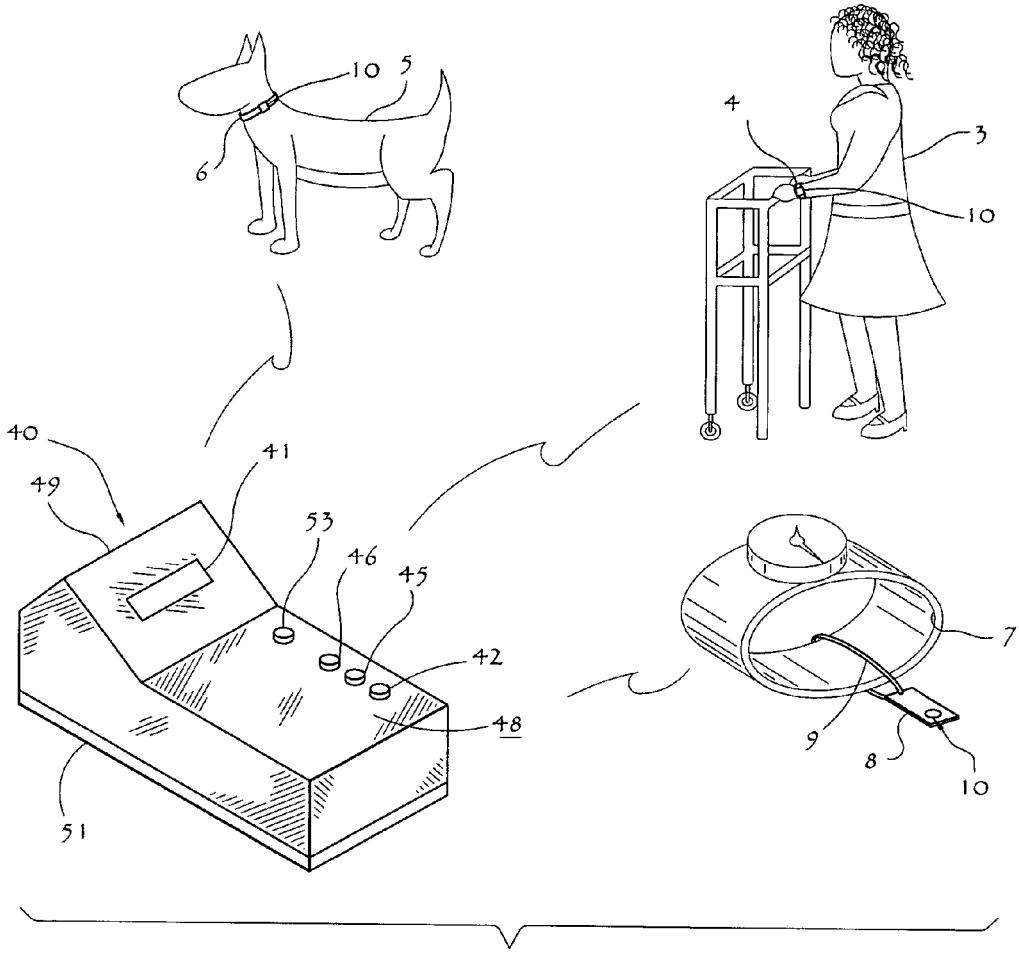
FIG. 1 depicts a receiver base unit with diverse target items bearing transmitters.
Figure 2:
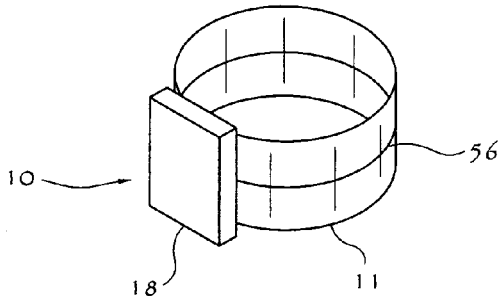
FIG. 2 details a possible transmitter to be worn by a target item.

With reference now to the figures, and in particular to FIGS. 1-2, a general scheme of the present invention depicts multiple targets 1 being tracked by a single monitoring base unit 40 according to the present invention. The present invention has a wide variety of applications, some of which are depicted in FIG. 1, such as keeping track of ambulatory patients 3 at a nursing home or hospital, tracing livestock or pets 5 within a neighborhood (not shown), or tagging expensive merchandise 7 to assure it does not leave a retail premises without being purchased. One having ordinary skill in the art will recognize that other targets 1 may be monitored, with appropriate variations as described below, without departing from the spirit and scope of the present invention.

Transmitter 10 typically employs attachment means 11 appropriate to target 1. For example, as depicted in FIG. 2, transmitter 10 includes an elastic strap 11 forming a loop adapted to surround the arm for comfortable wear by patient 3. Alternately, transmitter 10 could be integrated with the ubiquitous hospital bracelets 4 commonly worn by patient 3 in a hospital, nursing home or hospice. For livestock or pets 5, transmitter 10 could be coupled to their collars 6, ear tags (not shown), other identifying apparel (not shown) or even embedded into their skin (not shown). For expensive merchandise, transmitter 10 may comprise a small tag 8 attached by tether 9 or could be included in the clothing alarm tags (not shown) attached with magnetically locked pins that pierce the merchandise used in apparel retailing. One having ordinary skill in the art will recognize that all manner of attachment means are contemplated by the present invention, with concomitant variations in form dictated by the circumstances.

In the theft prevention application, unobtrusiveness is a desirable trait. In FIG. 2, transmitter 10 is depicted enclosed within a substantially rectangular box or case 18, but case 18 could be reduced considerably in size. Components discussed below require only that case 18 be approximately 1⅛ inches in diameter and ⅛ inch high, making it resemble a wristwatch. In fact, a preferred case 18 would resemble a wristwatch and strap 11 would resemble a watch band if transmitter 10 were to be worn by a patient. One having ordinary skill in the art will recognize that all such variations in case 18 adapted to contain the components of transmitter 10 are considered within the spirit and scope of the present invention.

Base unit 40 comprises housing 49 having front face 48 bearing user interface devices such as control switches 42, 45, 46 and LCD 41 providing a readout of selected information about transmitters 10. Preferably, base unit 40 is a hand-held, portable device that normally sits in a central location within the area in which targets 1 are expected to remain, but which can move with the operator as he attempts to locate a given target 1 because base unit 40 detected an out-of-range condition for that target 1's transmitter 10. One having ordinary skill in the art will recognize that these distinct functions (monitoring all transmitters 10 and searching for an errant target 1) may be embodied in separate devices. For example, the monitoring function could be embodied in a stationary base station (not shown) while a portable base unit 40 could duplicate its search and detection functions while being useful to accompany the operator on a mobile search for target 1. Both functions, however, can be embodied within a single base unit 40 which can be operated to select between these functions, as discussed below.

Figure 3:
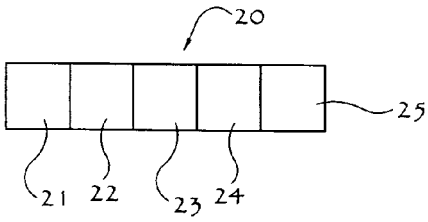
FIG. 3 depicts a five byte word transmitted to the base unit by each transmitter.

Referring now also to FIGS. 5A-5B and 6A-6E, transmitter 10 comprises microcontroller 13 adapted to generate five byte word 20 (FIG. 3) and transmit it at millisecond intervals defined by prime numbers selected from a plurality of prime number intervals according to Chart A. Each transmitter 10 may be set to transmit at a single prime number interval to reduce interference from other transmitters 10. See FIG. 6D. Each transmitter 10 thus remains detectable by base unit 40 and distinguishable from other transmitters 10 and from background noise despite the fact that numerous transmitters 10 are within the scanning area of base unit 40. Base unit 40 preferably is capable of tracking at least sixty (60) transmitters 10 transmitting at prime number intervals up to approximately 500 milliseconds before the practical upper limit of prime number interval transmissions is reached.

Figure 5A:
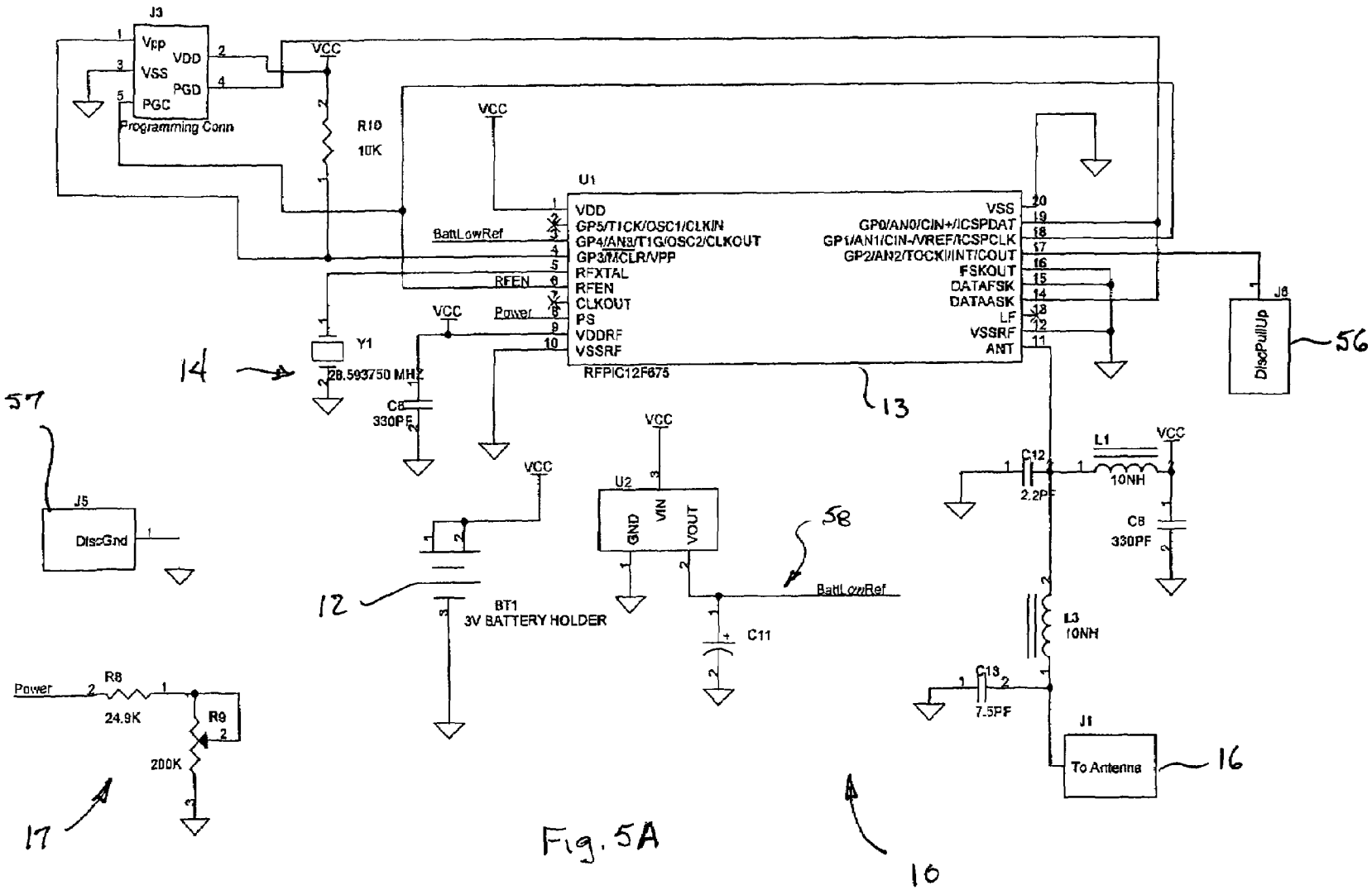
FIGS. 5A-5B show schematics of a preferred embodiment and an alternate embodiment, respectively, of transmitters according to the present invention.
Figure 5B:
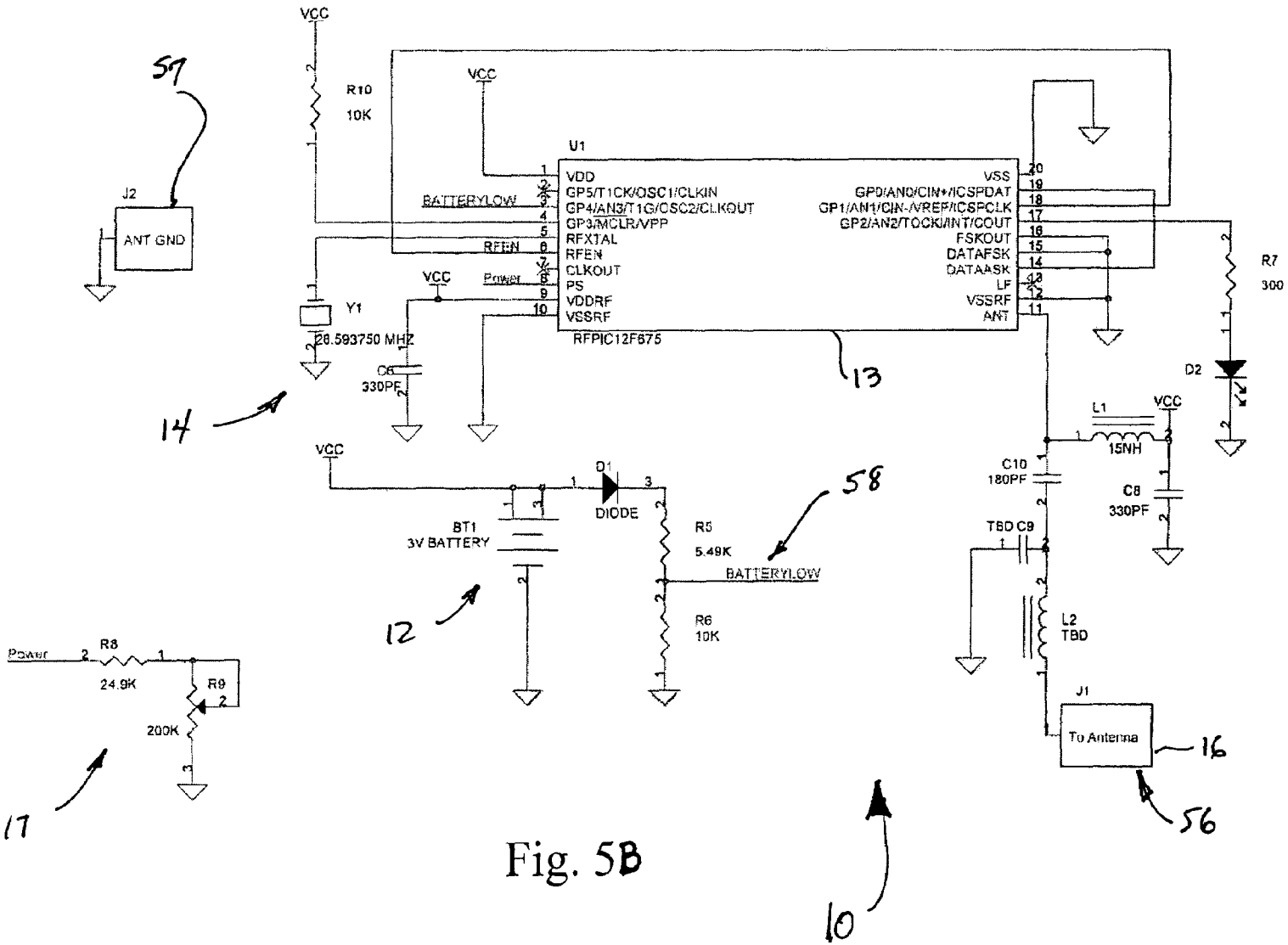
Figure 6A:
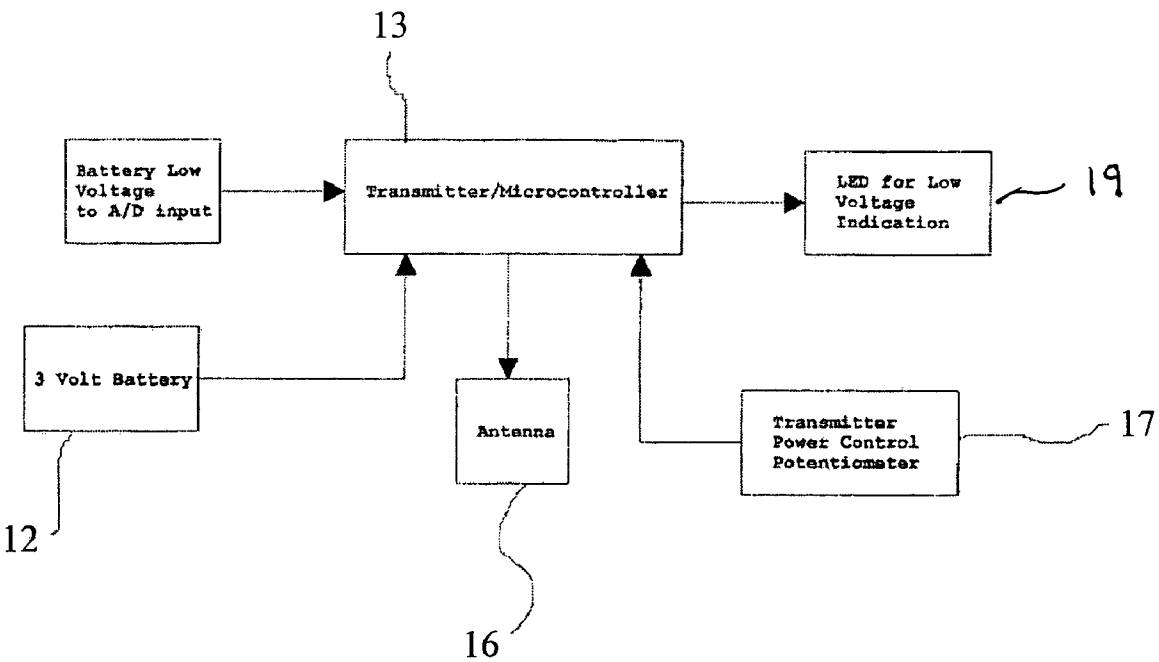
FIGS. 6A-6E show block diagrams of the functions performed by the transmitters of FIGS. 5A and 5B.
Figure 6B:
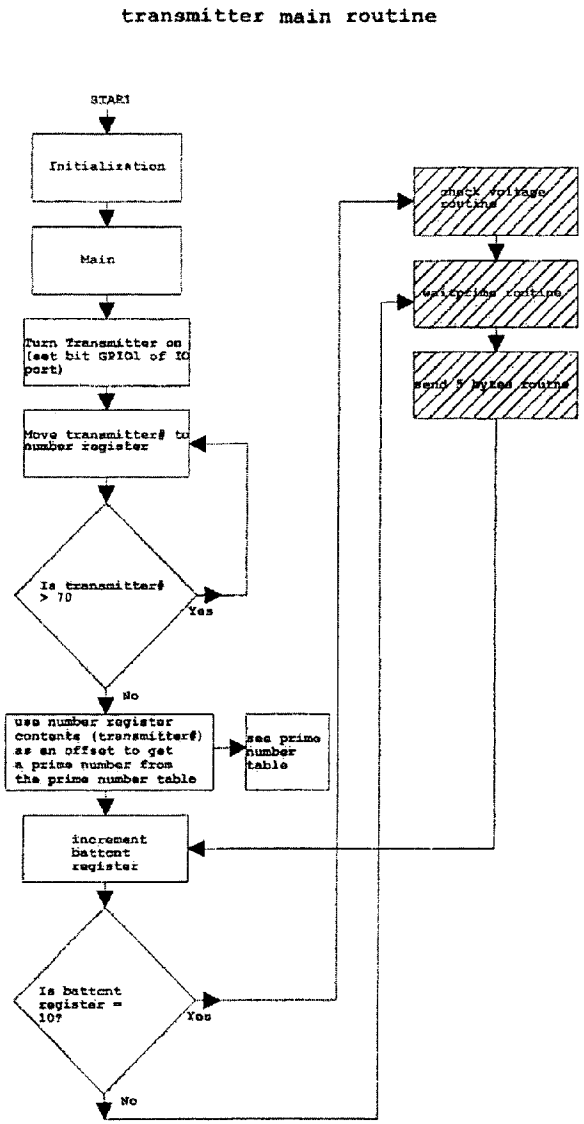
Figure 6C:
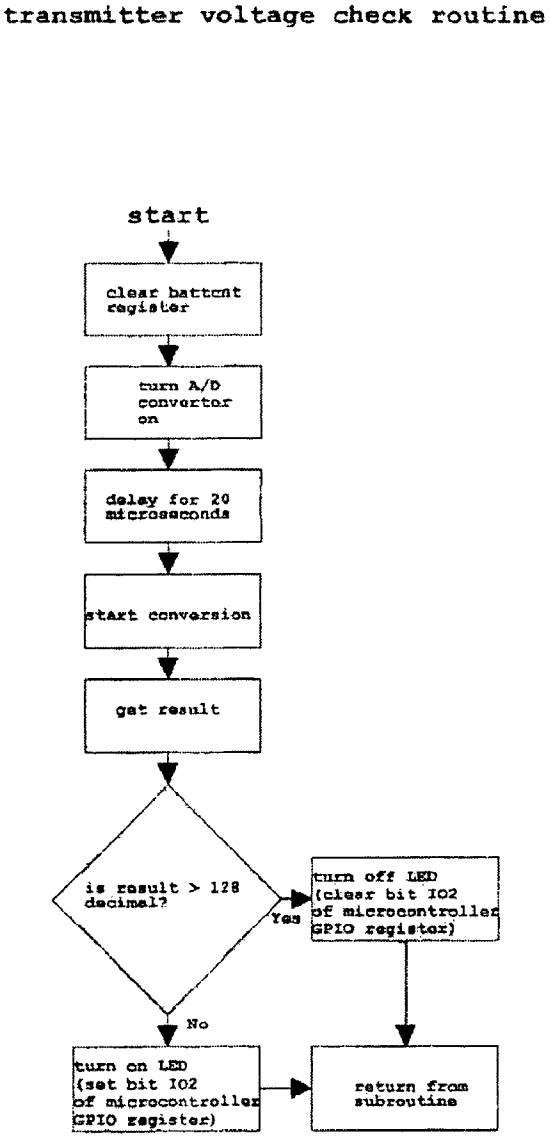
Figure 6D:
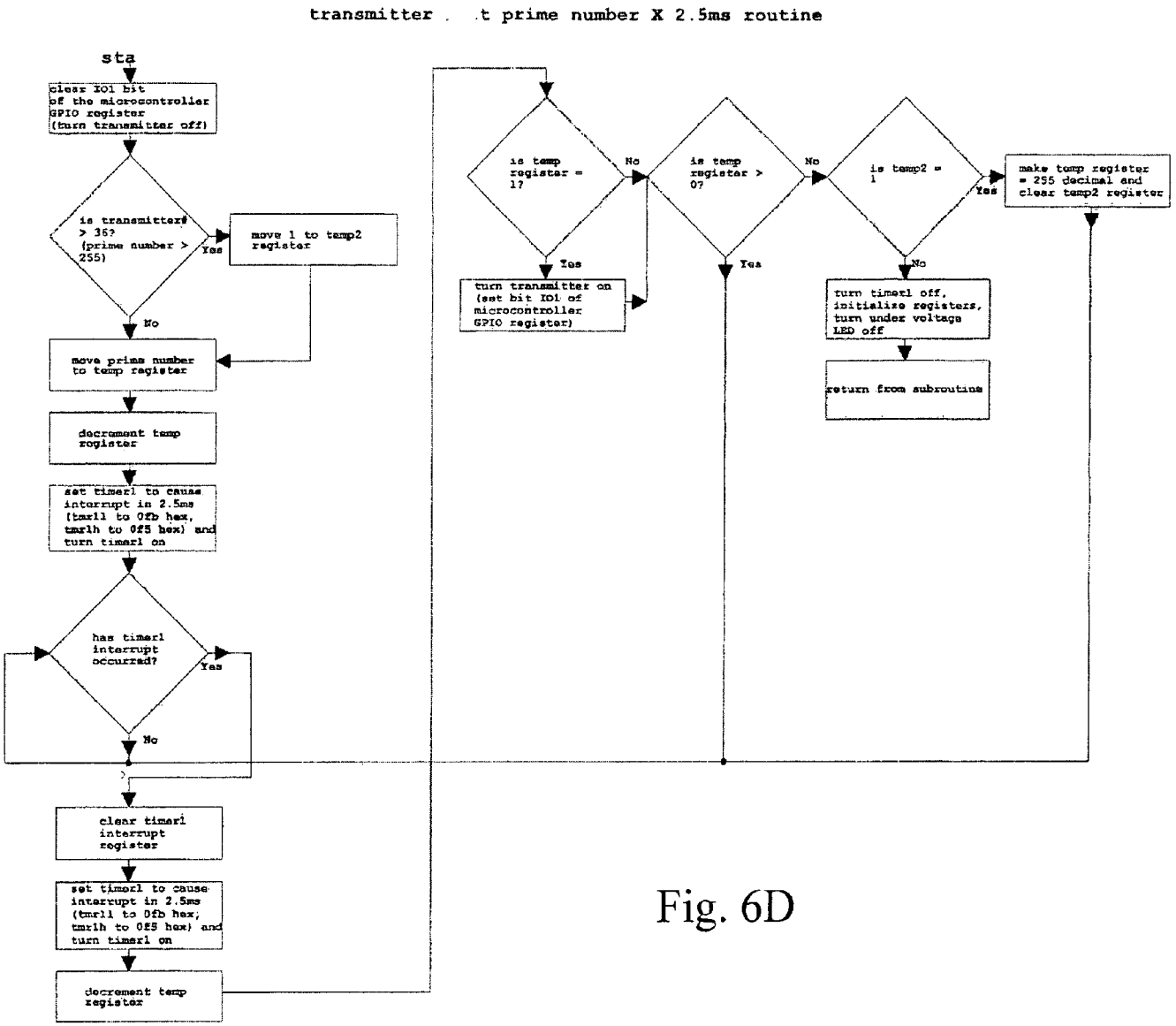
Figure 6E:
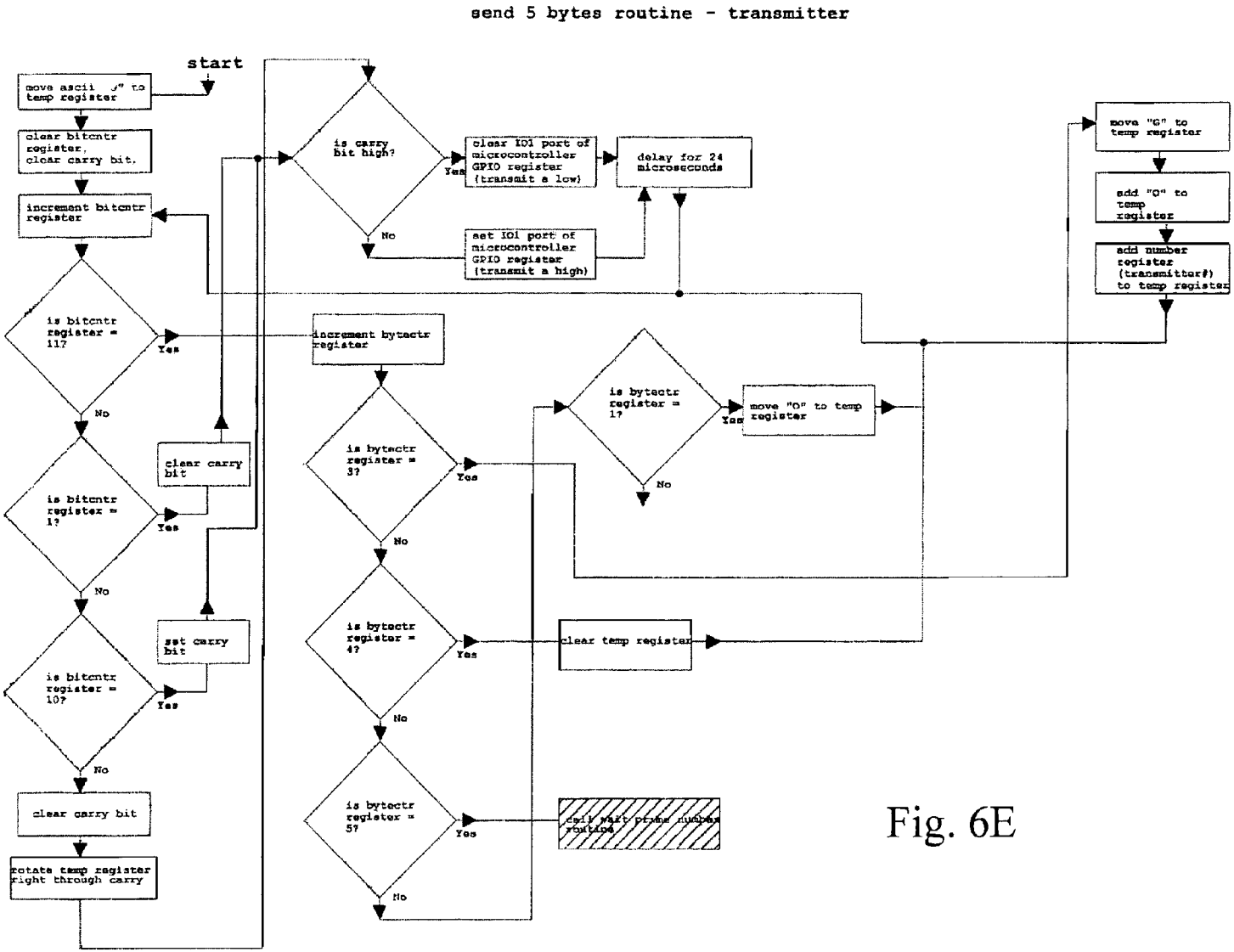

As depicted in FIGS. 5A, 5B, transmitter 10 further comprises microcontroller/transmitter 13, battery pack 12, RF generator 14 and transmitter antenna 16. A suitable transmitter microcontroller 13 is RFPIC12F675H-ISS available from Microchip Technology, Inc. of Chandler, Ariz. A suitable battery 12 is a single coin cell or two (2) quadruple 'A' (2-AAAA) batteries commonly available commercially. Transmitter antenna 16 preferably comprises a quarter (¼) wave loop antenna wrapped around the inside of case 18, but transmitter antenna 16 alternately may serve a dual purpose, as discussed below.

Preferably, transmitter 10 transmits to base unit 40 at 915 megahertz (MHz), the frequency commonly used by cellular telephones and pagers. Alternately, transmitter 10 may utilize the 433.9 MHz band used in Europe for such devices. One having ordinary skill in the art will recognize that transmitter 10 could operate at any frequency without departing from the spirit and scope of the present invention. For the preferred 915 MHz band, transmitter antenna 16 would comprise a quarter wave loop of approximately three (3") inches in length.

Transmitter 10 preferably generates a one (1 mW) milliwatt RF signal capable of being detected by base unit 40 using its omnidirectional antenna 51 (FIG. 7B) as long as transmitter 10 remains within a short distance of base unit 40, preferably up to approximately 250 feet. As discussed in detail below, base unit 40 further is capable of detecting the same signal with its directional antenna as long as it remains within a distance of approximately 450 feet. One having ordinary skill in the art will recognize that the foregoing physical distance limitations are artifacts of the components selected and the purpose to which the present invention is applied, and that all variations thereon are considered to be within the spirit and scope of the present invention. For example, transmitter 10 further included potentiometer 17 (FIGS. 5A. 5B) which may be employed to set the power output fed to transmitter antenna 16, thereby providing means for reducing the distance transmitter 10 may be detected by base unit 40. This enables operators of a system employing the present invention to increase or decrease the apparent radius within which targets 1 must remain to avoid triggering an out-of-range condition and alarm within base unit 40.

As best seen in FIGS. 5A, 5B, transmitter microcontroller 13 is powered by battery 12, providing approximately three (3 vdc) volts direct current input to pin VCC of transmitter controller 13. Low battery signal 58 is tied to pin 3 of transmitter controller 13, which allows controller 13 to monitor battery 12. When VCC drops as battery 12 begins to run low, the voltage value at signal 58 drops correspondingly. Transmitter controller 13 can be set to detect a low battery condition from signal 58 long before battery 12 drops below the minimum VCC at which controller 13 can operate. Controller 13 then sets a bit within word 20, as discussed in more detail below, to trigger an alarm at base unit 40 that the battery needs to be replaced well before transmitter 10 ceases to operate.

FIG. 5A also illustrates another valuable feature of the present invention whereby transmitter 10 sounds an alarm to base unit 40 if transmitter 10 has been removed from target 1. As depicted in FIG. 2, a disconnect loop 56 may be embedded within strap 11 or otherwise deployed to surround a portion of target 1, such as the wrist of the patient wearing hospital band 4 or the neck of the animal wearing collar 6. Loop 56 comprises a material of considerable mechanical strength and sized such that it cannot be removed from target 1 without being disconnected. Loop 56 also comprises an electrical conductor coupled to an input of transmitter controller 13 and looped back to ground 57 (See FIG. 5A where loop 56 is represented by a box electrically coupled to pin 17 of controller 13 and grounded at grounding connection 57. This provides affirmative logic to transmitter 13 confirming that loop 56 remains in tact, thus implying that transmitter 10 remains attached to target 1. If loop 56 becomes disconnected or broken, ground 57 no longer couples to pin 17 and cannot confirm to controller 13 that transmitter 10 is attached to target 1. Controller 13 is programmed thereupon to set a bit within word 20, as discussed in more detail below, that triggers an alarm in base unit 40.

In an alternate embodiment of the foregoing, as illustrated in FIG. 5B, transmitter antenna 16 itself provides the function of loop 56. In such case, where transmitter antenna 16 becomes decoupled from antenna ground 57 (FIG. 5B), transmitter 10 would cease transmitting, setting off an out-of-range alarm at base unit 40 and drawing the attention of an operator just as effectively as would the breaking of loop 56, as discussed above. Where transmitter antenna 16 is used in this fashion, it may be necessary to lengthen transmitter antenna 16 sufficiently that it can surround a portion of target 1, such as the wearer's wrist or neck (FIG. 1). In such case, transmitter antenna 16 may have to be a half-wave or full-wave loop instead of the preferred quarter-wave loop discussed above. For the preferred transmitter frequency discussed above, transmitter antenna 16 thus would become six (6") inches (half-wave loop) or twelve (12") inches (full wave loop). One having ordinary skill in the art will recognize that all such variations come within the spirit and scope of the present invention.

Turning now again to FIG. 3, signal word 20 generated by transmitter 10 carries several distinct pieces of information using an alpha-numeric code of known convention, such as ASCII, about transmitter 10 to base unit 40. Preferably, bytes 21-23 carry identifier and status information about transmitter 10, including to which base unit 40 it transmits. Fourth byte 24 provides error detection and correction for word 20 using checksum convention, thus assuring that word 20 is not corrupted by background noise or other random error. Byte 25 provides a distance measurement, as discussed in detail below.

Within byte 22, the first two bits (bits 0 and 1) preferably are flag bits which signify to base unit 40 that disconnect loop 56 (or alternately transmitter antenna 16) is grounded and that controller 13 is not detecting a low battery condition, as discussed above. Bits 2 through 7 preferably signify a unique identifier for transmitter 10, essentially a binary number. Using seven bits in byte 22 word 20 can carry a unique numeric identifier for up to sixty-three (63) different transmitters 10. When base unit 40 monitors a selected prime number interval signal and happens to detect more than one word 20 being transmitted at that interval, base unit 40 can distinguish between them based on the transmitter 10 and base unit 40 identifiers in word 20 and select the correct signal to monitor, ignoring the other(s).

If transmitter 10 happens to be detected by more than one base unit 40, word 20 carries in bytes 23, 24 ASCII character identifiers, e.g. "G" and "O", each having a corresponding ASCII numeric value, that signify a particular base unit 40 to which transmitter 10 is transmitting. This allows the appropriate base unit 40 to identify its target 1 and to disregard a target 1 it is not set to monitor. This could occur, for example, when two base units are operating in a single area where their monitoring ranges overlap, or where they are monitoring different types of targets 1. Other base units 40 can be assigned other character identifiers. Using two bytes 23, 24 creates the possibility of having as many as 255×255 base units 40 operating in the same area, though this is highly unlikely to occur. Using two bytes 23, 24, however, allows for the possibility that two different base units 40 may intentionally monitor the same target 1 for different reasons, if base units 40 and transmitters 10 are so programmed. This could occur, for example, if the base units 40 were monitoring proximity to different boundaries, such as where there was an off limits area (e.g. an unsafe zone) within a larger area of confinement.

Fifth byte 25 of word 20 provides base unit 40 a basis for determining signal strength, which base unit 40 utilizes to determine direction and distance from base unit 40 to transmitter 10. Specifically, byte 25 is set to a high value (ASCII value 255, or all 1's in an 8-bit byte), thus creating the maximum analog signal for byte 25. As base unit 40 samples the analog signal emanating from transmitter 10, it detects an analog signal strength even though bytes 21-25 are digitally valued to provide digital information to microcontroller 60 of base unit 40. Thus, if analyzed digitally, bytes 21-24 could comprise an analog value of anywhere from zero to 255 (i.e. some combination of 0's and 1's in an 8-bit byte, thus totaling less than 255) for each byte 21-24. By setting byte 25 always to all 1's (ASCII value 255), the analog signal thereof always is set at a maximum. By sampling the signal at 26 millivolts per decibel (dB) and calculating the analog value as a percent of the maximum signal strength, where if transmitter 10 is adjacent base unit 40, microcontroller 60 can estimate the distance to transmitter 10 from base unit 40.

Figure 7A:
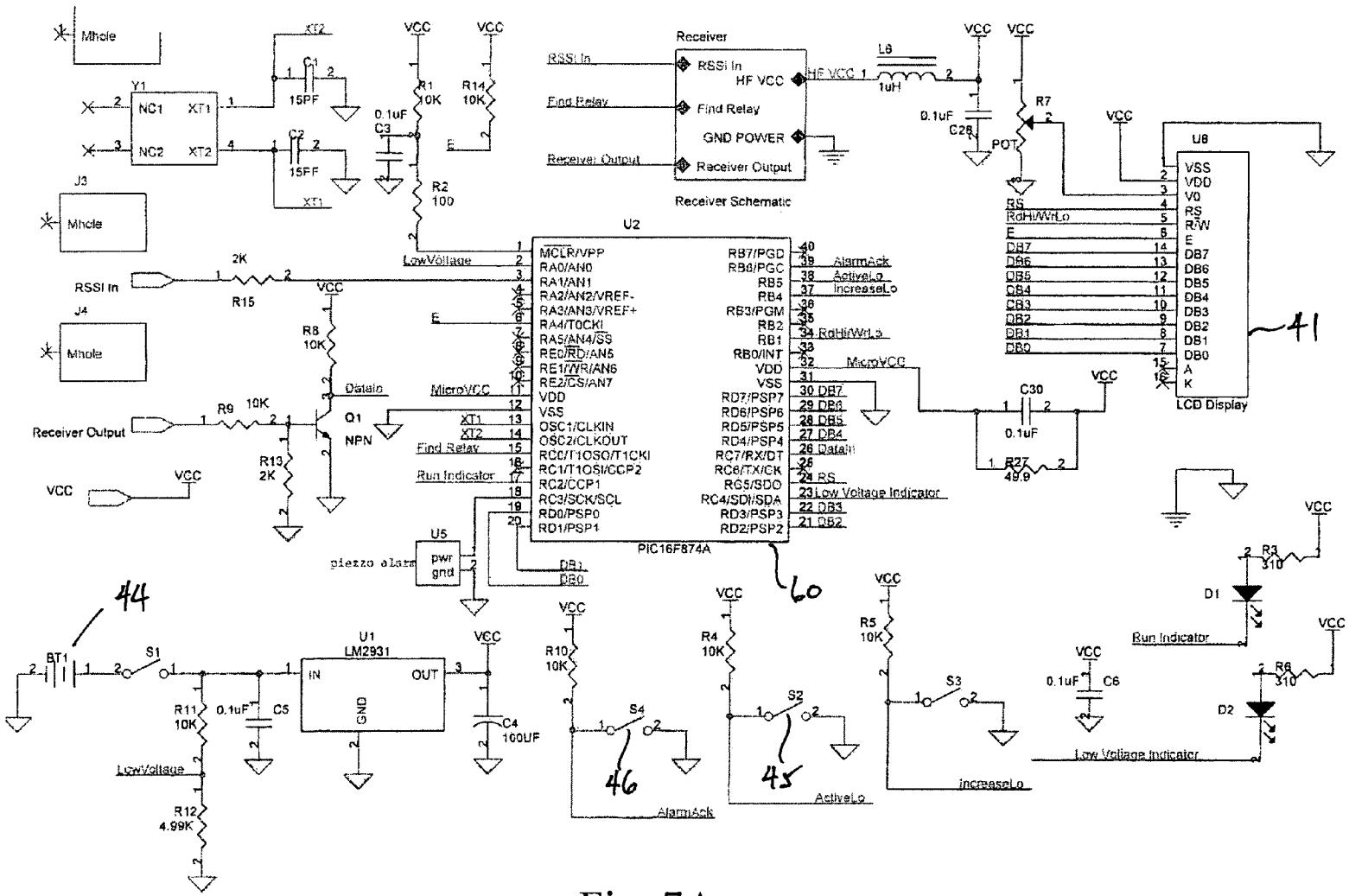
FIGS. 7A-7B show a schematic of a preferred embodiment of a base unit according to the present invention.
Figure 7B:
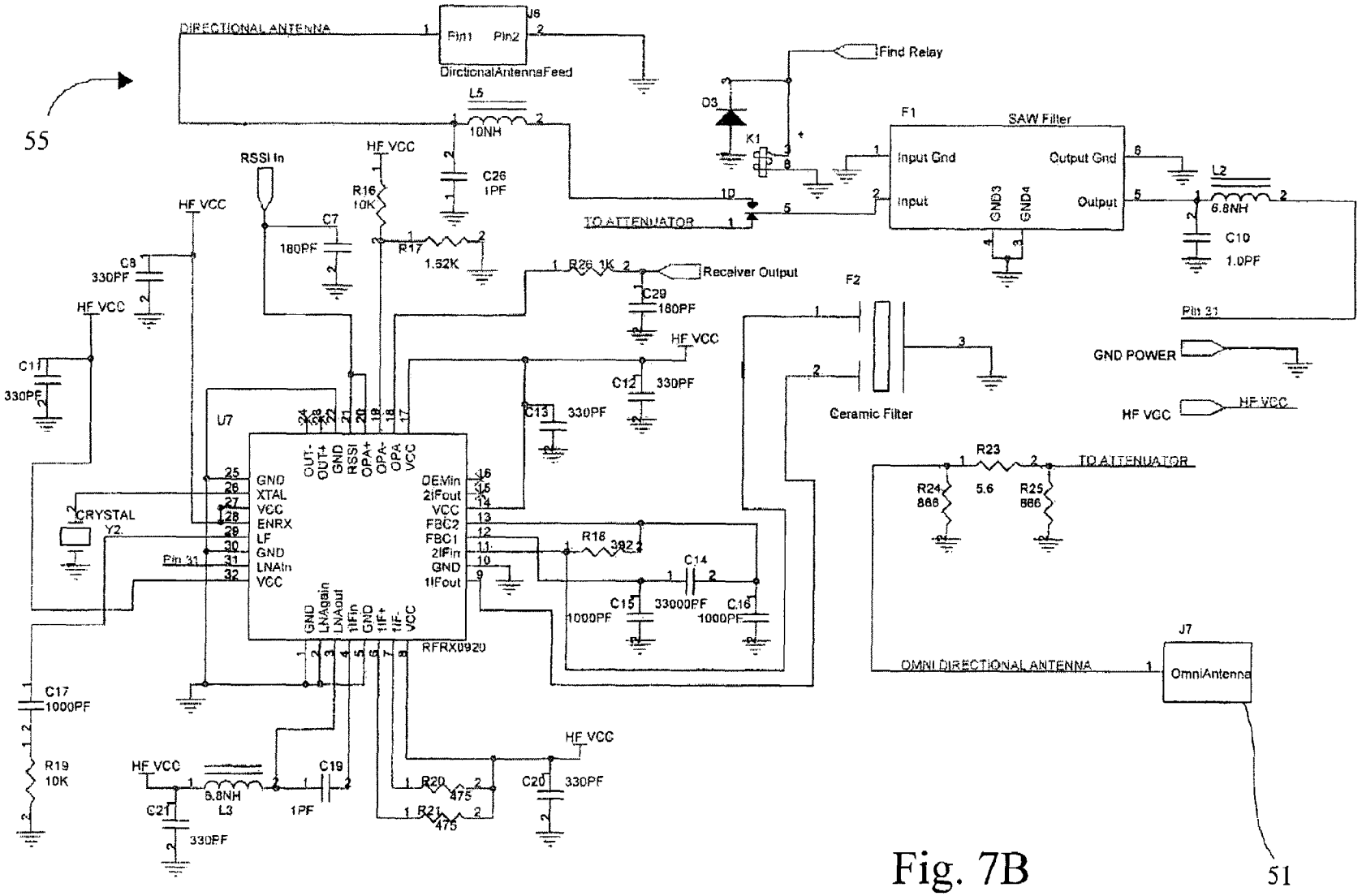

Referring again to FIG. 1 and also turning now to FIGS. 7A, 7B, base unit 40 further comprises antenna system means 50 for receiving signals from transmitters 10, receiver 70 for detecting signals coming through antennas 50 and microcontroller 60 for analyzing detected signals and integrating transmitter 10 database information for detected transmitters 10 with the user interface. Receiver 70 couples between antenna system 50 and controller 60 to provide analog-to-digital conversion of the signal so that coded signal word 20 from transmitter 10 may be analyzed by controller 60, as discussed in more detail below.

Figure 8A:
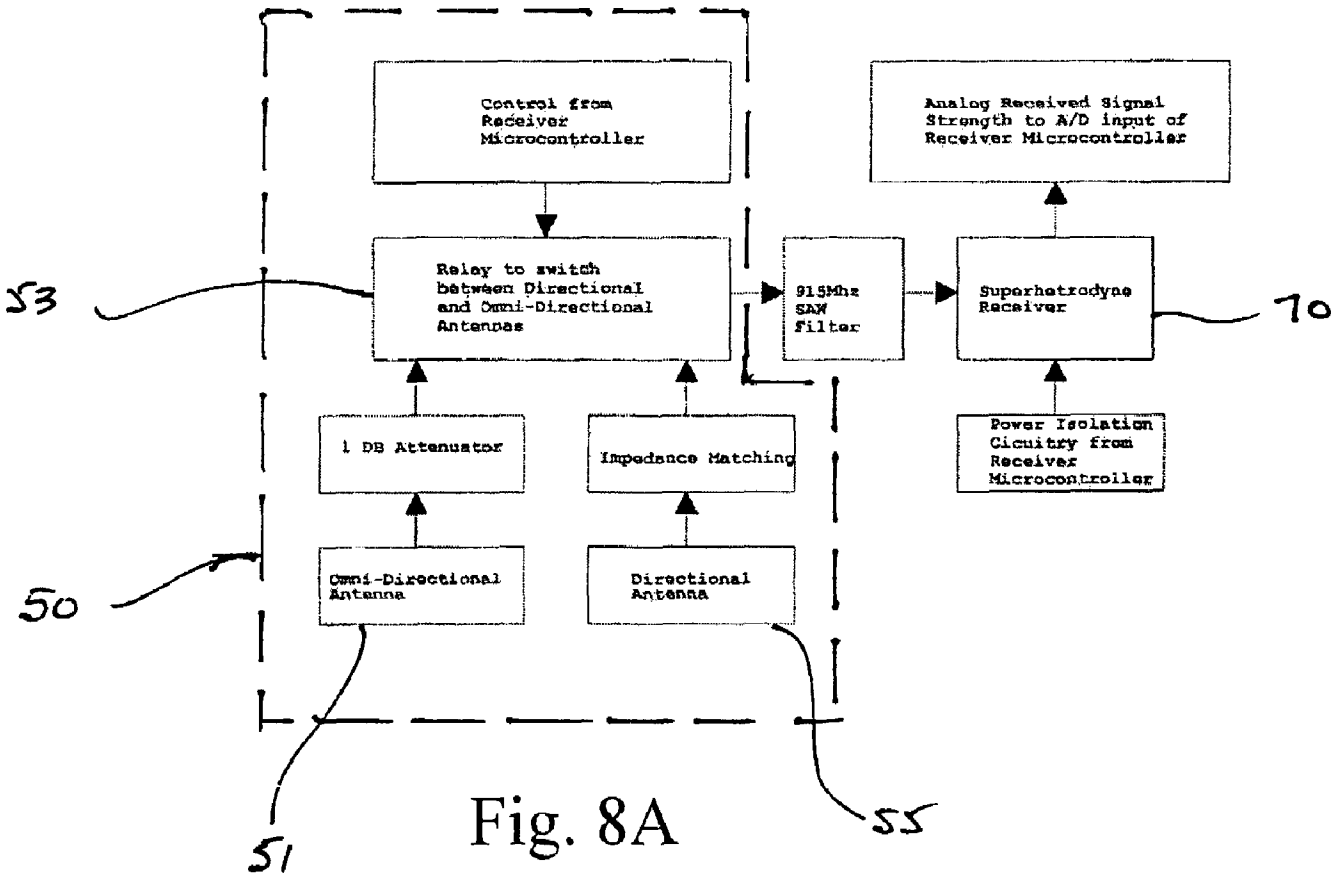
FIGS. 8A-8U show block diagrams of the functions performed by the base unit of FIGS. 7A-7B.
Figure 8B:
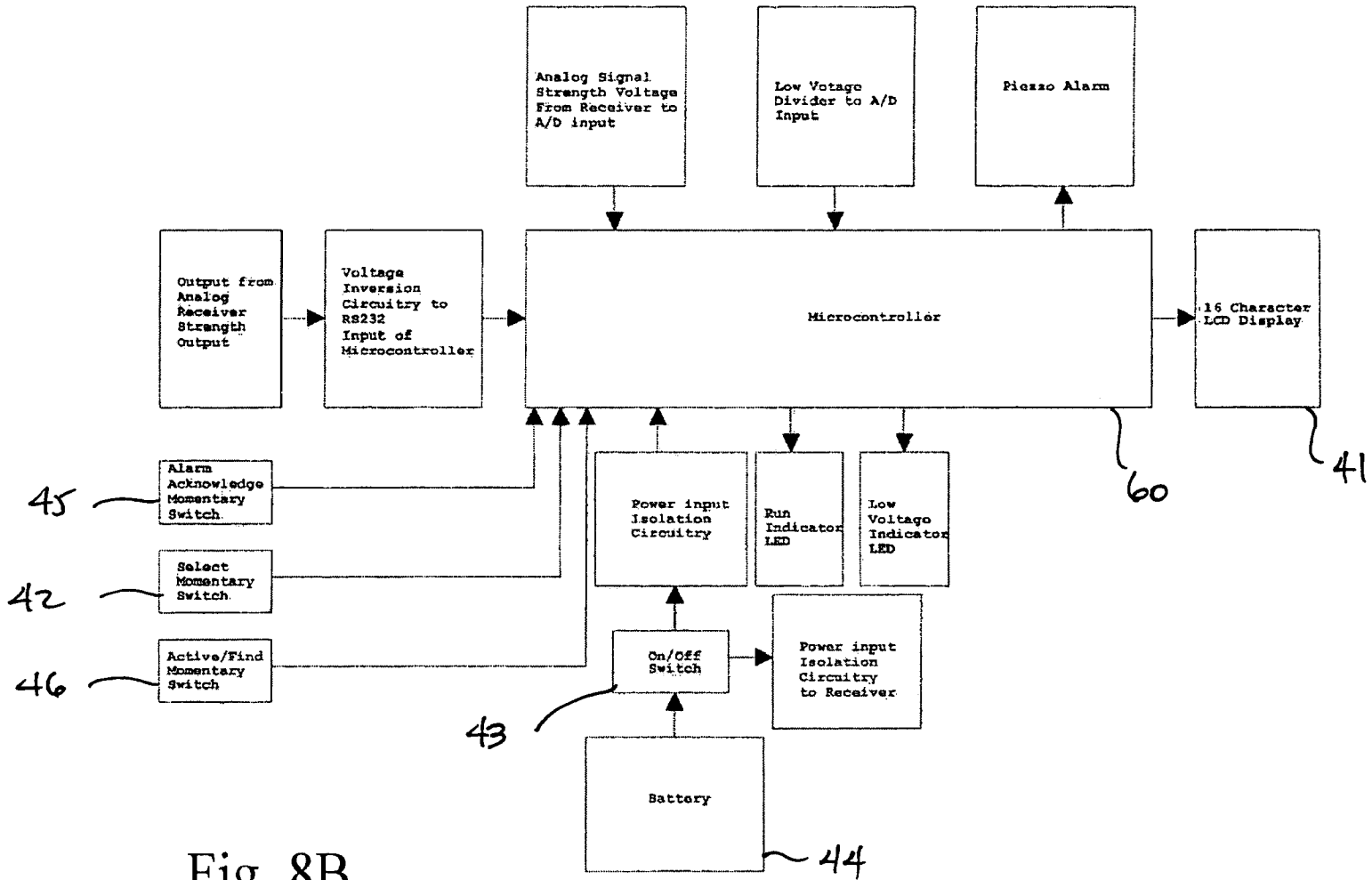

Antenna system 50 comprises omnidirectional antenna 51 and directional antenna 55, each selectable for different functions of base unit 40. Both antennas 51, 55 are contained within or built onto housing 49 and coupled to controller 60 through receiver 70 (FIG. 8A). Switch 53 on face 48 provides an operator with the capability to manually select between antennas 51, 55 depending upon the function being performed. Preferably, directional antenna 55 is a Yagi type reflector/director dipole antenna etched onto a circuit board (not shown) integral with base unit 40. A suitable antenna system is described in U.S. Pat. No. 6,307,525 to Britain.

Figure 8C:
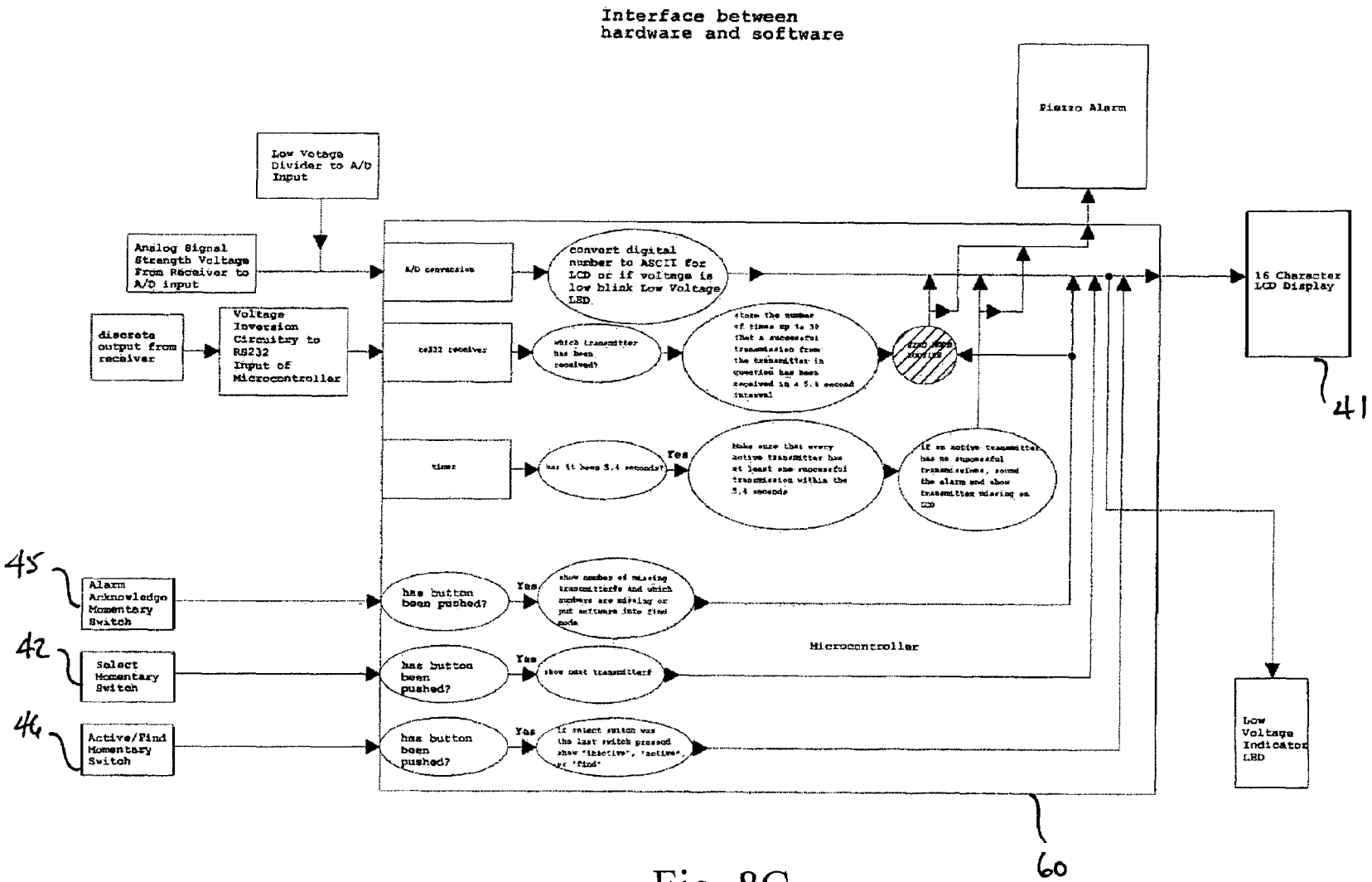
Figure 8D:
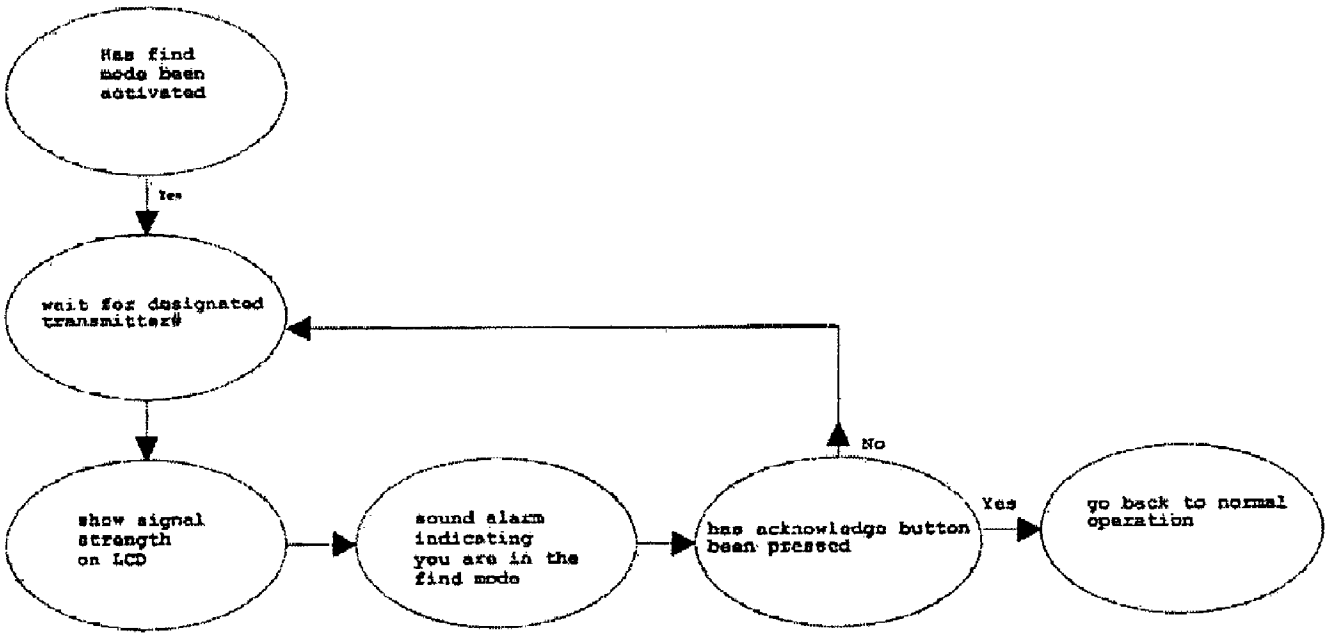
Figure 8E:
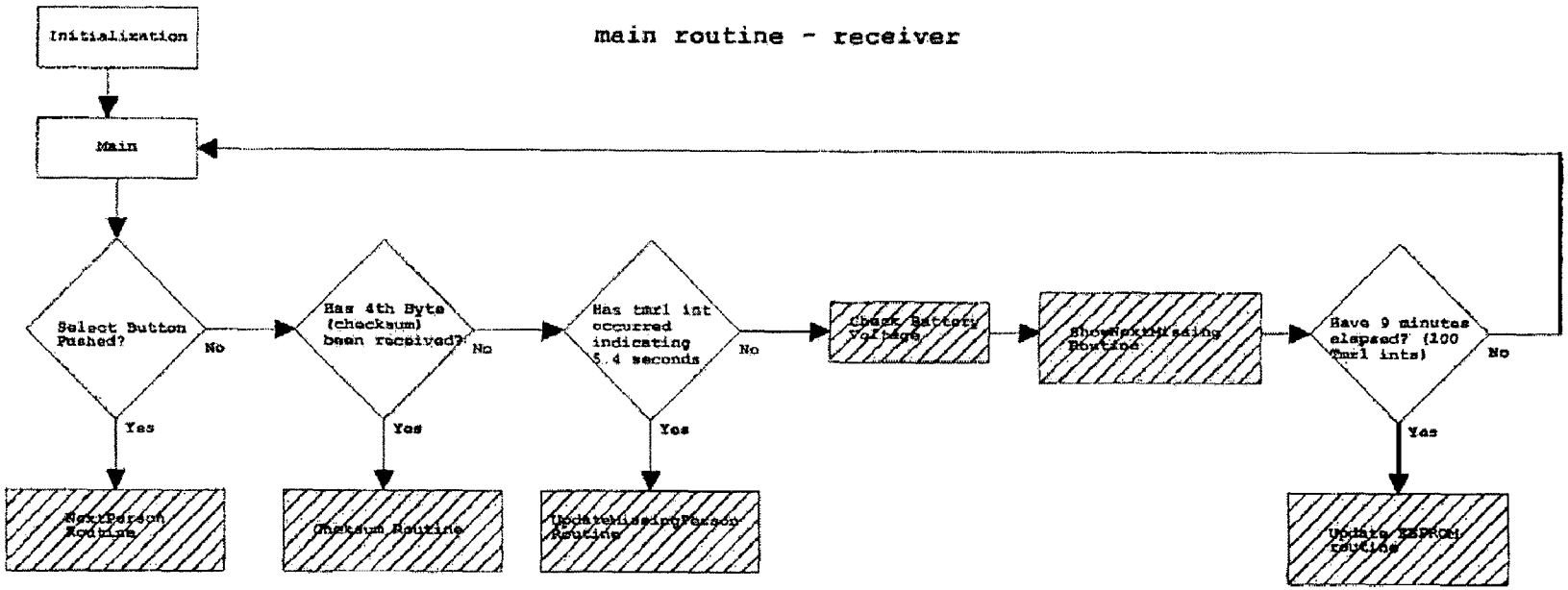
Figure 8F:
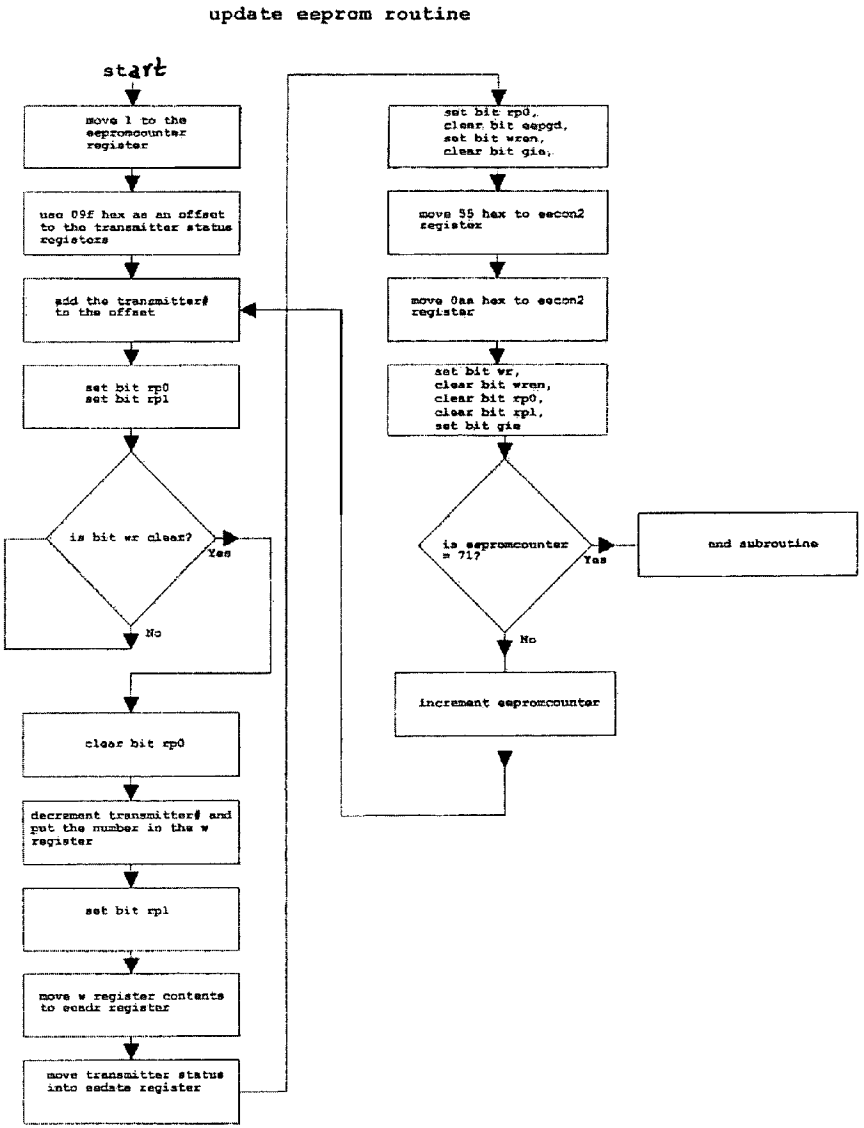
Figure 8G:
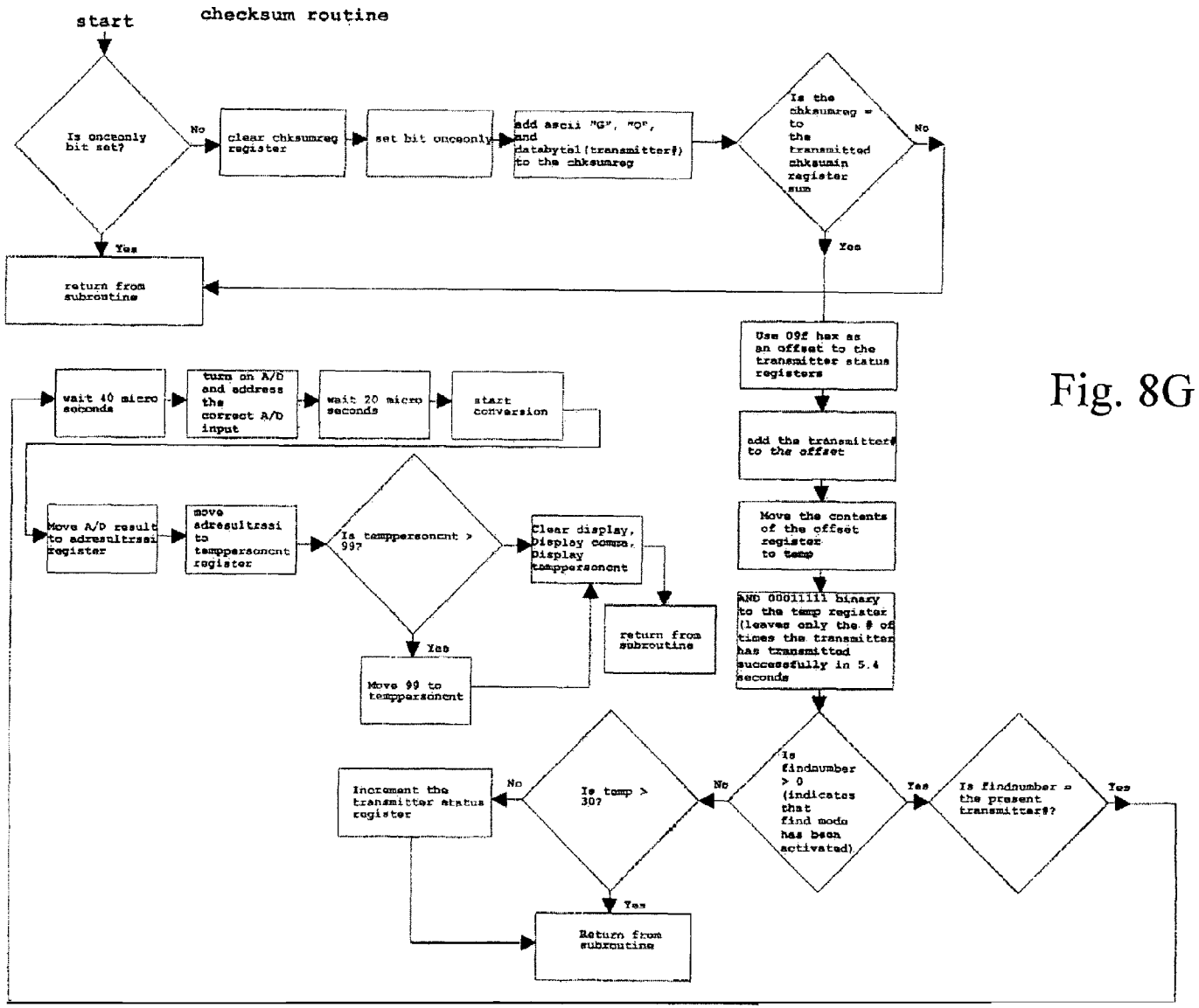
Figure 8H:
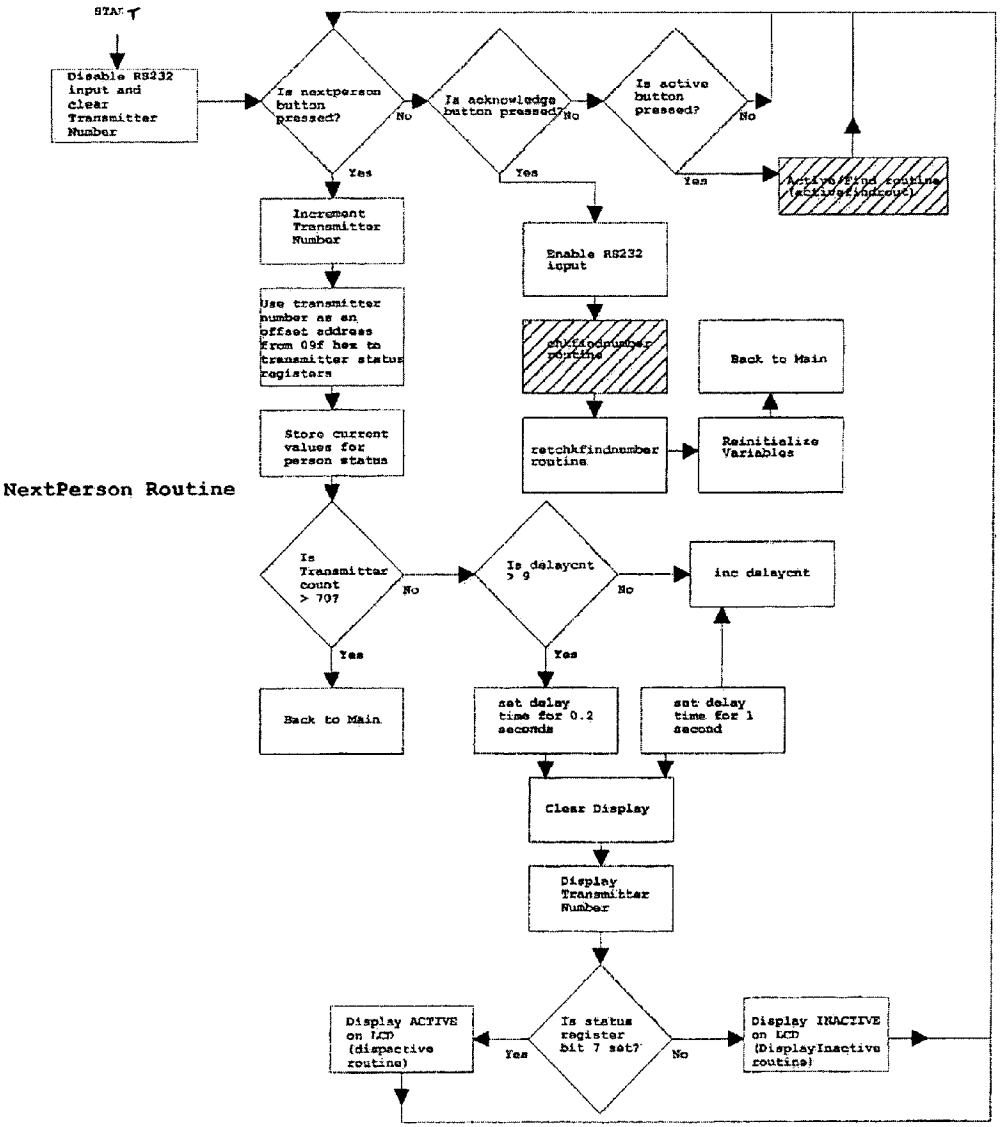
Figure 8I:
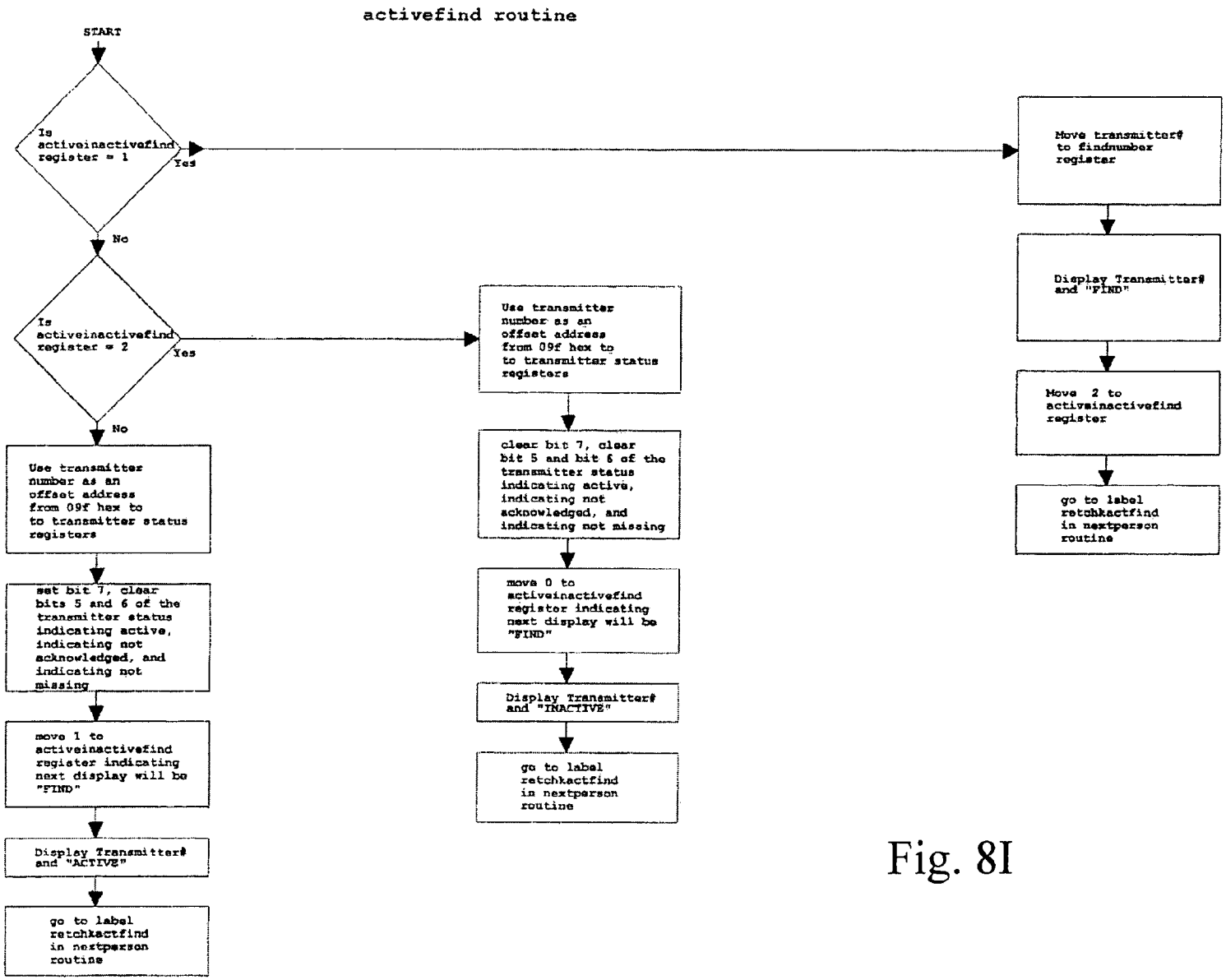
Figure 8J:
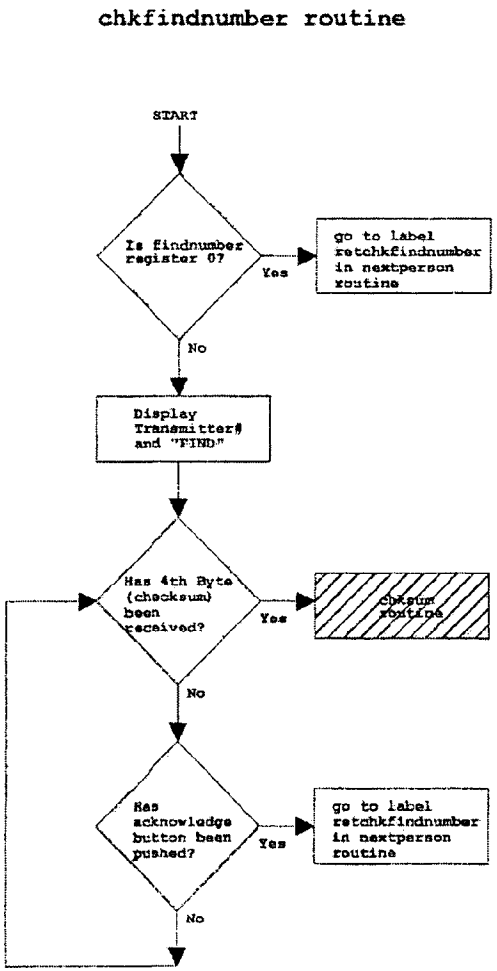
Figure 8K:
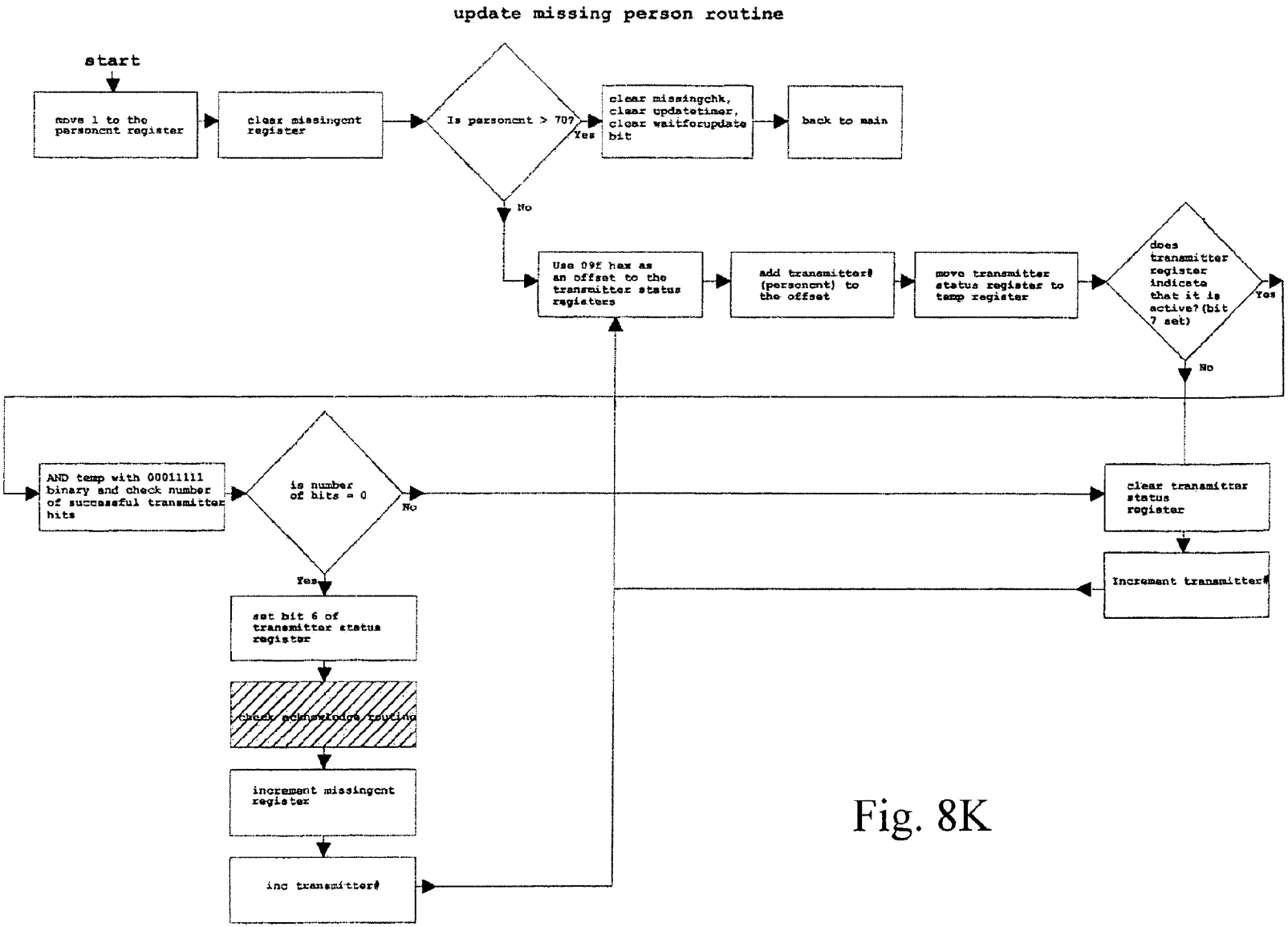
Figure 8L:
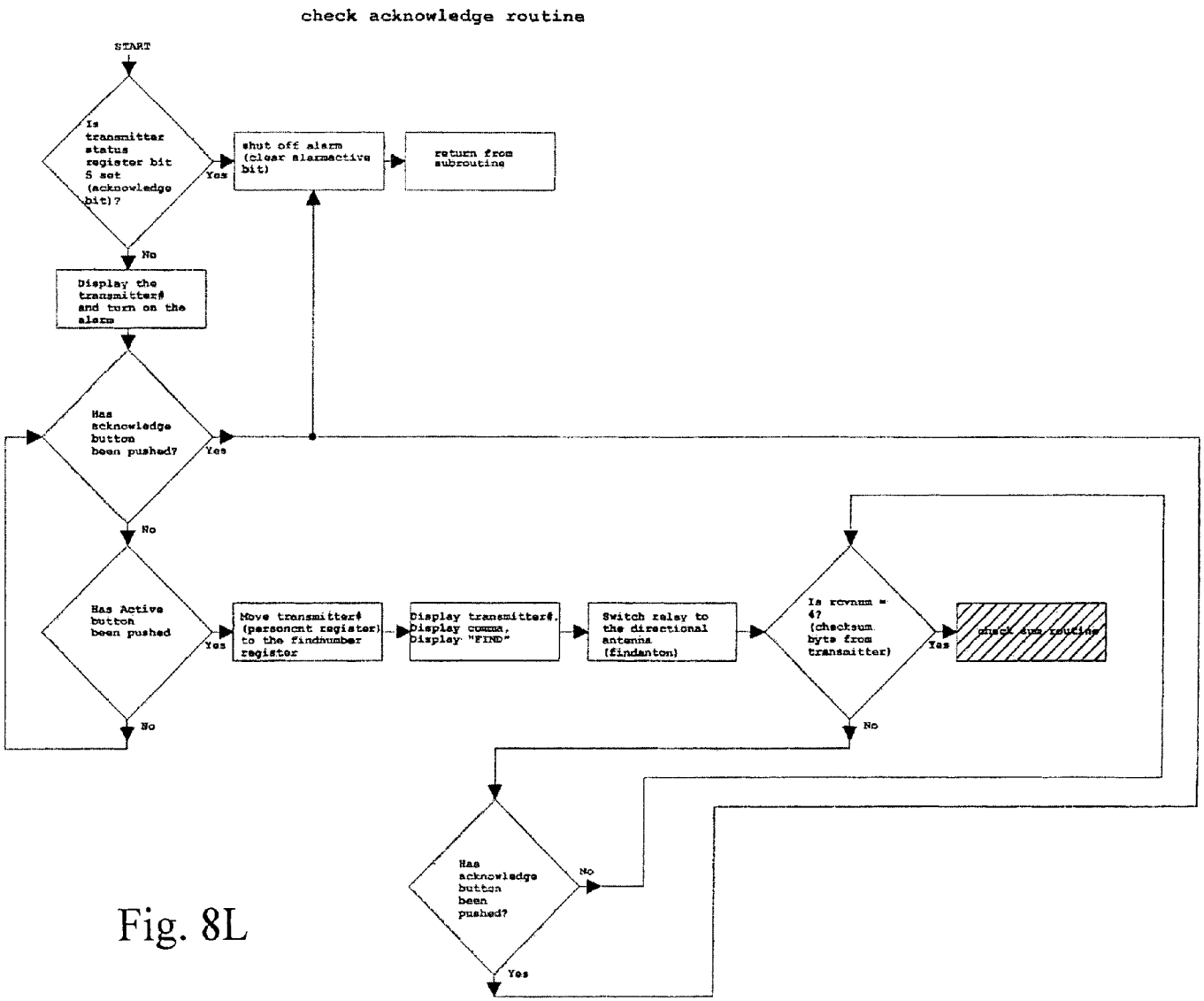
Figure 8M:
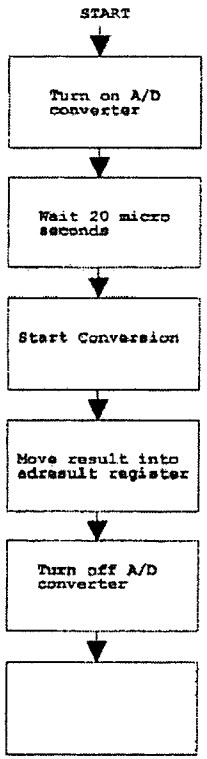
Figure 8N:
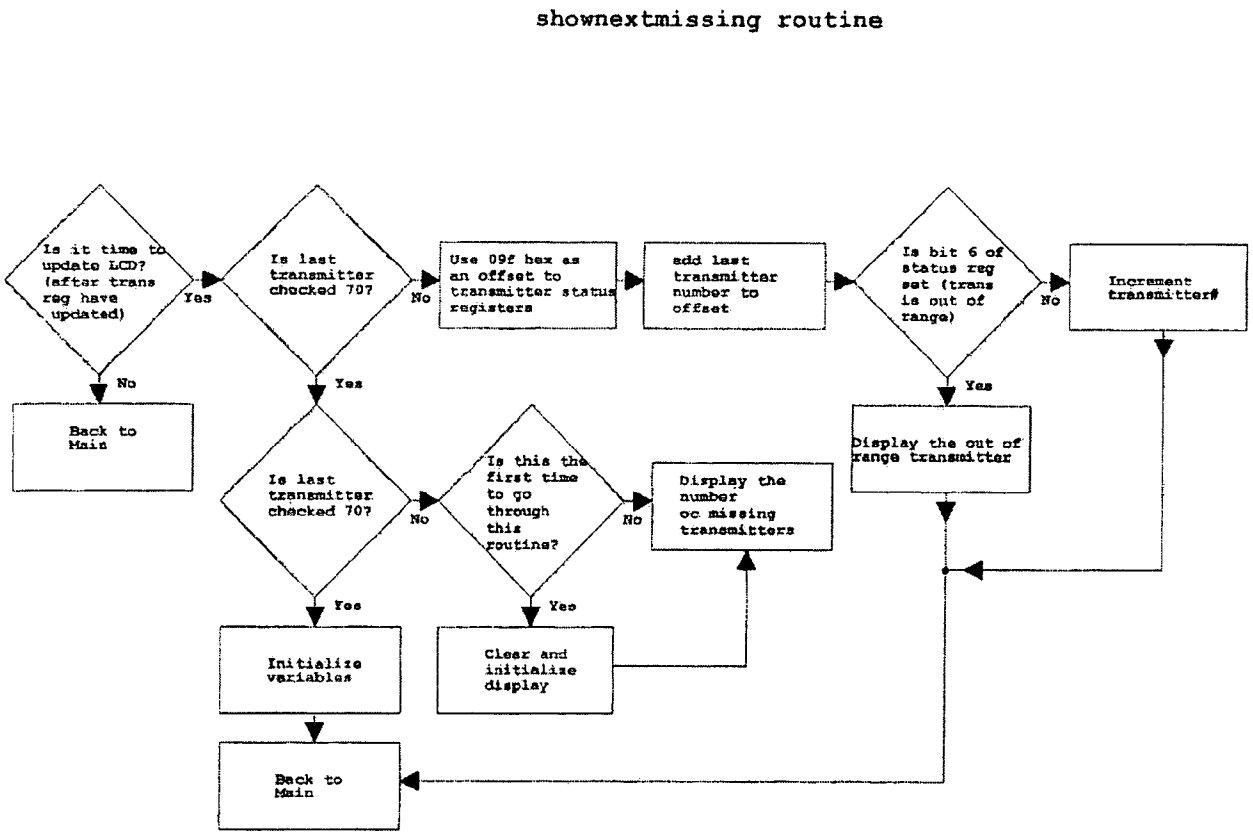
Figure 8P:
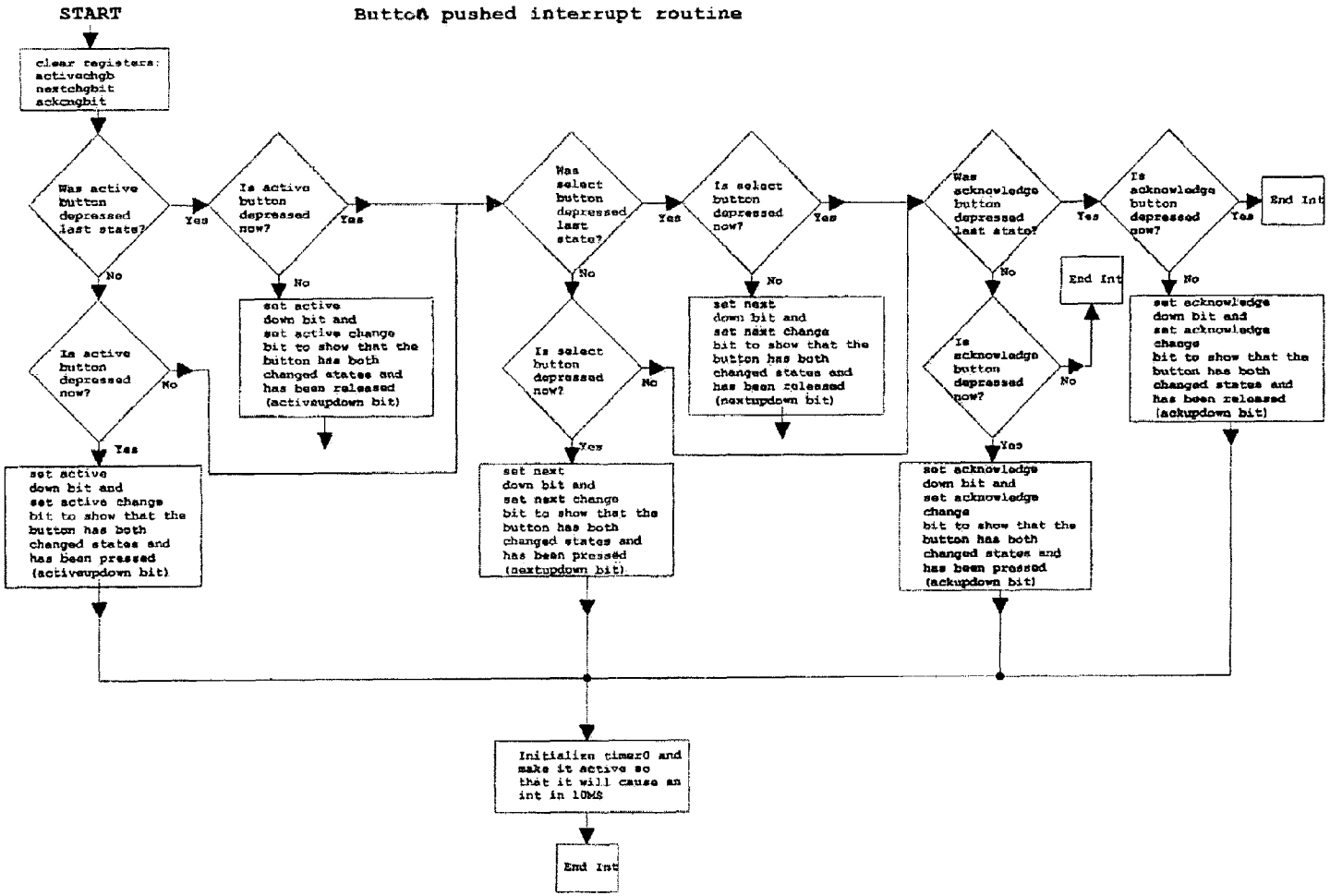
Figure 8Q:
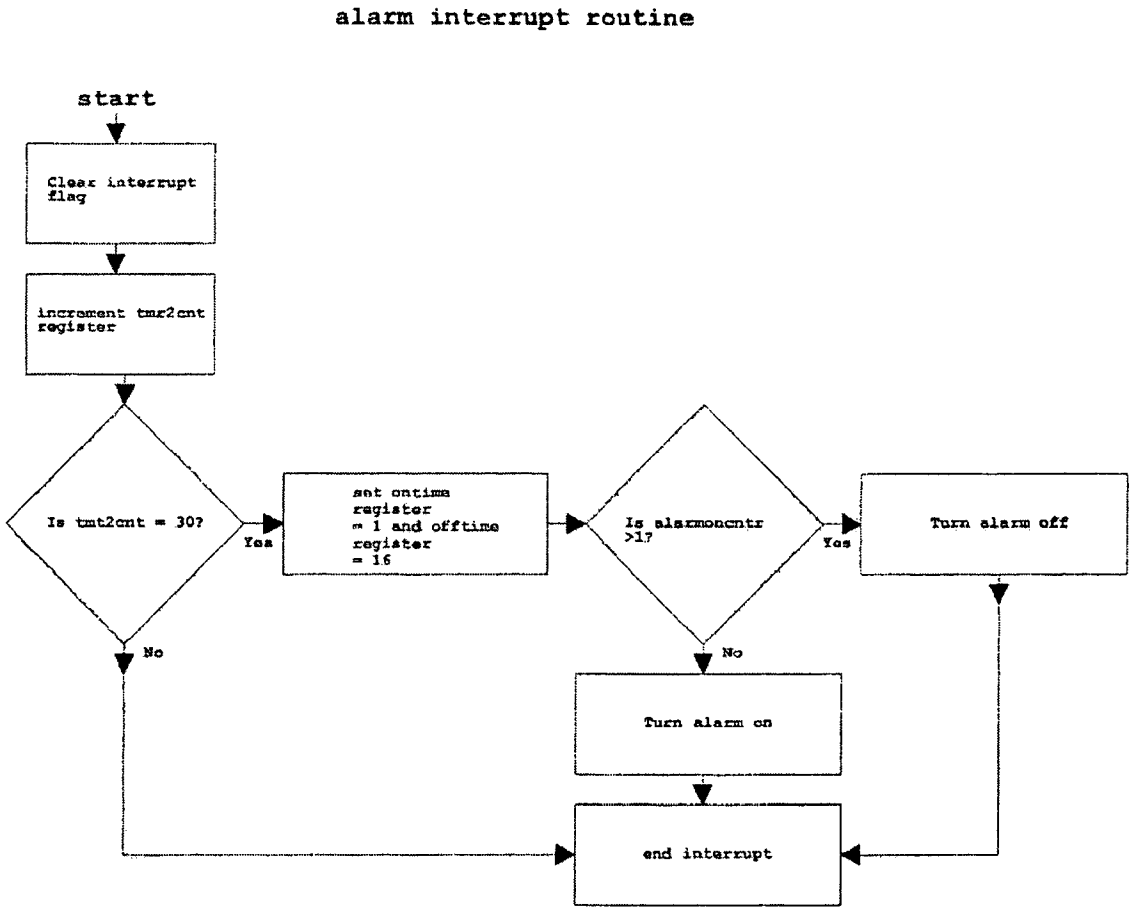
Figure 8R:
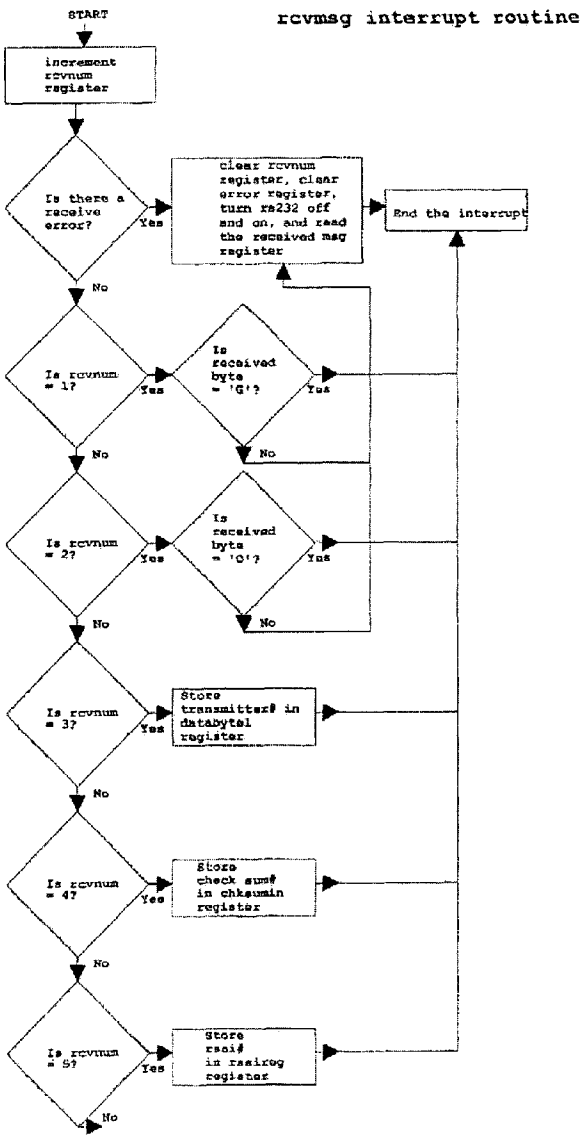
Figure 8S:
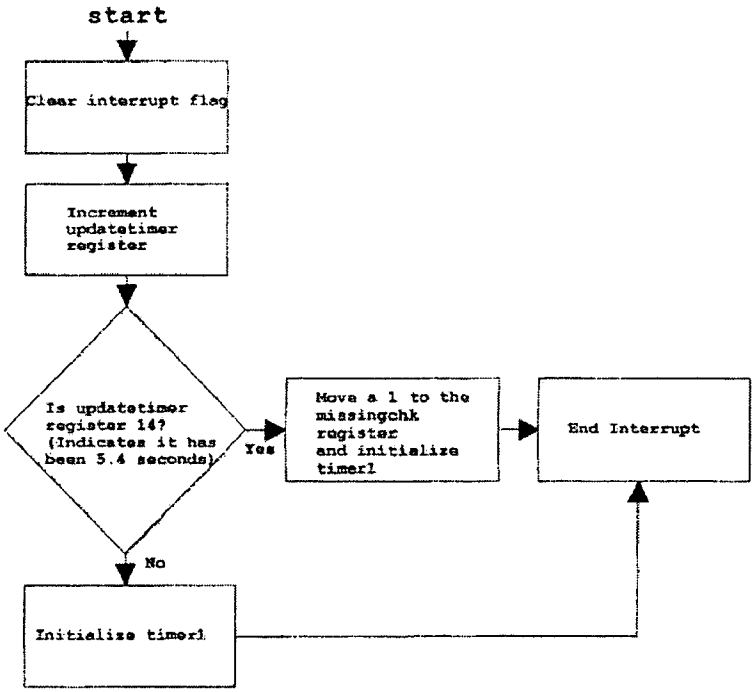
Figure 8T:
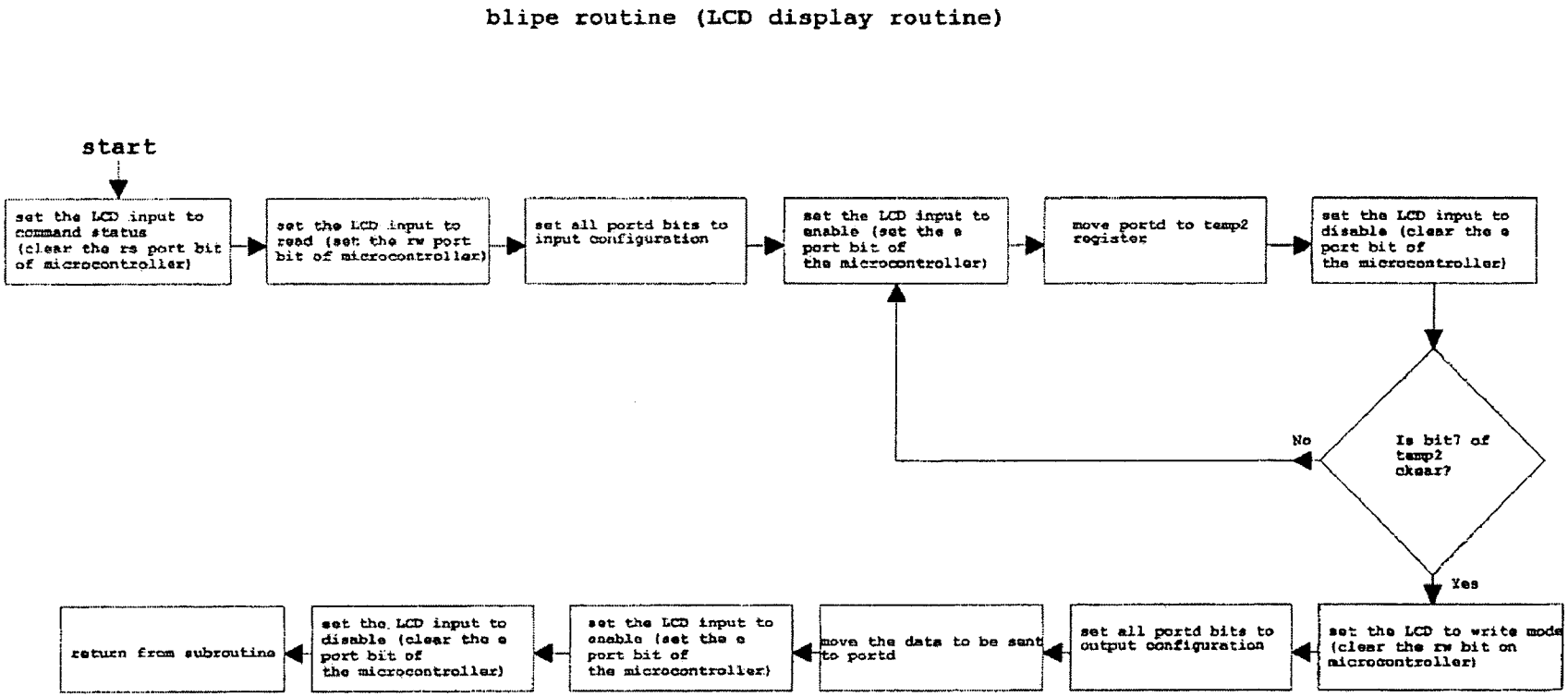
Figure 8U:
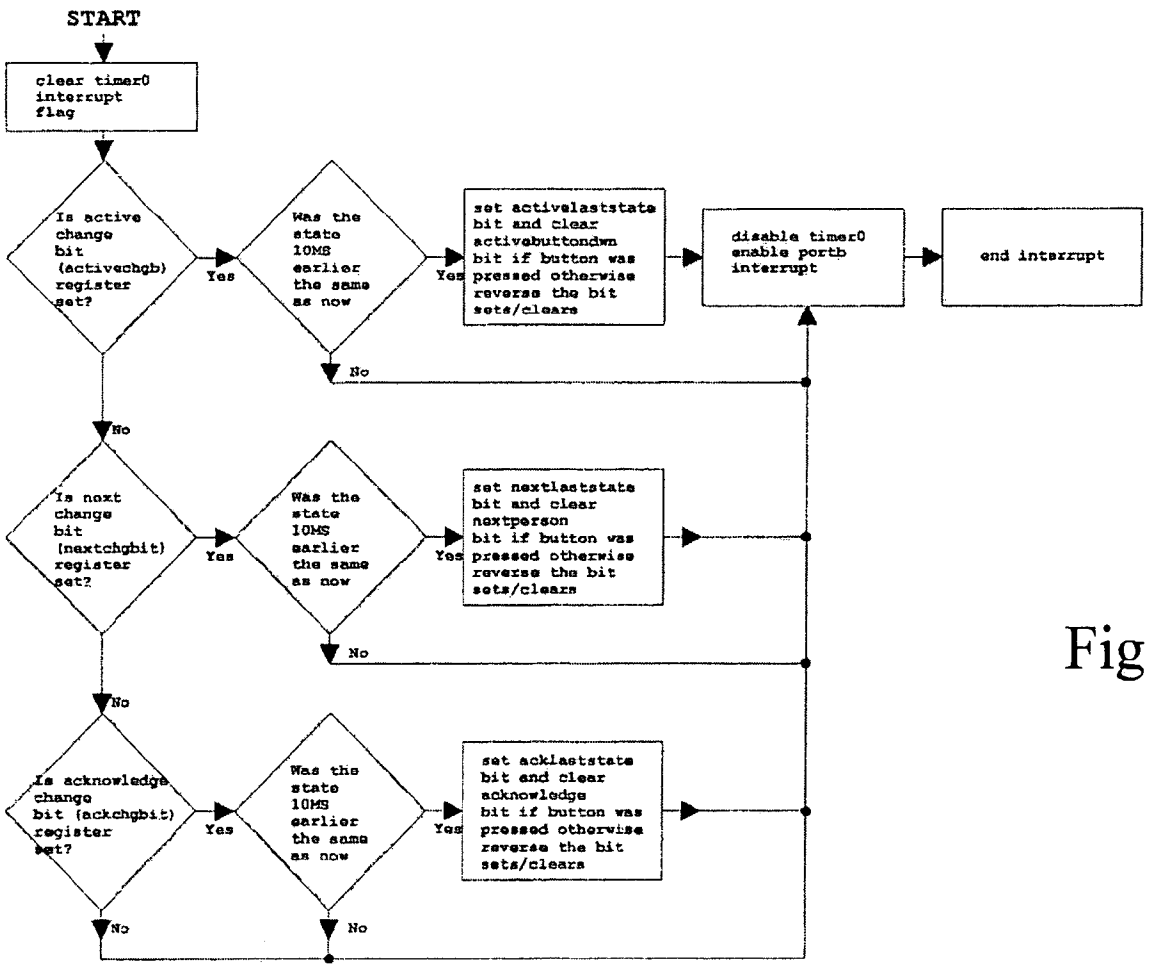

Processor 60 is programed for several functions. First, it receives from transmitters 10 coded signals in the form of word 20 and analyzes them as discussed above to provide updated status and identifying information to the operator (FIG. 8C). Processor 60 also integrates with a user interface disposed on face 48 of housing 49 and provides the operator with controls for responding to an alarm condition and for searching for the errant transmitter 10. FIGS. 8D-8U demonstrate the various routines carried out by processor 60 to parse information from user interface input buttons 42, 45, 46 and 53 (FIG. 1) for selecting which function to perform, and for analyzing coded signals from transmitters 10.

Controller 60 also maintains a database (not shown) of transmitters 10 assigned to base unit 40. Such database is designed to store in a record for each transmitter 10 its identifier number, status (active or inactive), the latest calculated direction and distance of transmitter 10 based on the last known detection of word 20 from transmitter 10, and, if so designed, additional data, such as information about target 1. Controller 60 can retrieve data and information from the database and display it with LCD 41 for the operator's inspection at any time. An operator thus can select one or more transmitters 10 to listen for specifically, should some other clue, such as a shout or other off-system alarm, indicate attention needs to be directed thereto.

For example, if the database is so constructed, specific information about target 1 could be retrieved by processor 60 and flashed onto liquid crystal diode (LCD) 41 in response to an out-of-range alarm, perhaps telling the operator what to look for (e.g. a particular item of merchandise) or whose name to call (should it be a pet or a patient in need of attention). Alternately, the identifier for transmitter 10 may be displayed for the operator to cross reference with a list identifying the wearer of transmitter 10 where such information is available. One having ordinary skill in the art will recognize that all such variations are considered within the spirit and scope of the present invention.

In operation, base unit 40 functions in two modes defined by the antenna it uses to scan for transmitters 10. In its normal mode, base unit 40 listens at the selected prime number intervals for any transmitters 10 which it considers active. Those transmitters 10 presumably are within normal distance, and base unit 40's omnidirectional antenna 51 (FIG. 7B) has enough gain to detect them. If an expected word 20 is not detected within approximately 5.4 seconds, transmitter 10 is consider out-of-range, triggering an alarm. If word 20 is detected within the envelope of this sampling cycle, then the out-of-range indication is cleared and operation proceeds as normal.

Should base unit 40 detect an out-of-range condition, the operator (not shown) of base unit 40 can switch to directional antenna 55 using the activate/find button 45 on base unit 40. Having a much greater gain using directional antenna 55, base unit 40 may be able to detect the errant transmitter 10 in time for the operator to bring assistance or find target 1 before disaster befalls, such as target 1 being spirited away by malevolent actors (not shown).

When an alarm signals an out-of-range condition for an active transmitter 10, preferably an audible alarm sounds to alert an operator. The operator then initiates an acknowledge routine (FIG. 8L) by depressing switch 45 (FIGS. 1, 4C, 8B, 8C) to notify controller 60 that he is aware of the alarm and wants information contained within controller 60's database about target 1 to which the out-of-range transmitter 10 is attached. Controller 60 then interrogates the database and displays the target 1 information (FIGS. 8K, 8L, 8N, 8S). Next, the operator may initiate a search routine (FIGS. 4B, 8I) by depressing activate/find button 46 to find transmitter 10.

Figure 4C:
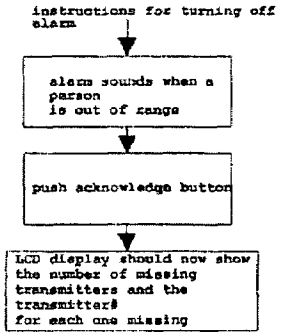
FIGS. 4A-4C show user interface flow diagrams of the present invention.
Figure 4B:
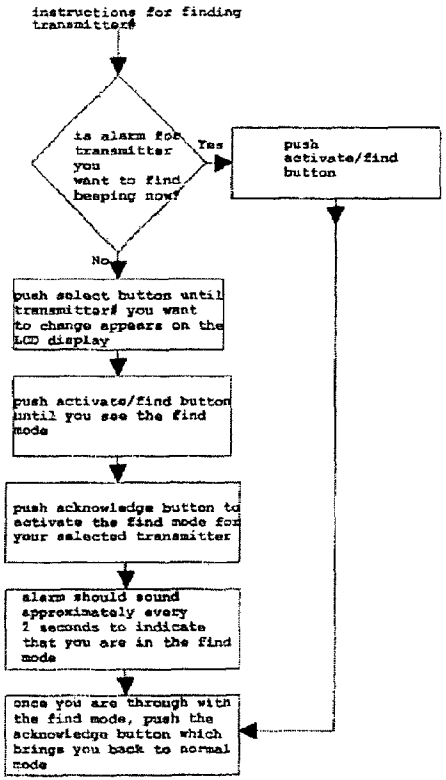
Figure 4A:
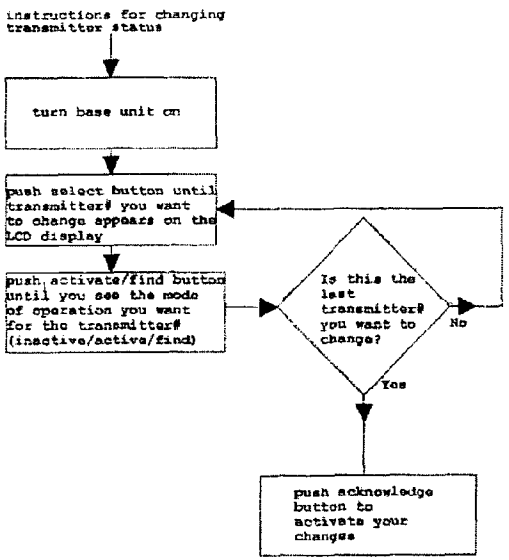

To carry out a search, the operator can verify the alarm by selecting transmitter 10 for azimuth and distance determination (FIG. 4B). Specifically, the operator switches from omnidirectional antenna 51 on base unit 40 to directional antenna 55, thereby amplifying the gain for signal strength detection. LCD 41 switches to a bar graph indicating signal strength calculated from byte 25 as discussed above. Should transmitter 10 remain within the larger range detectable with directional antenna 55, the operator then can rotate base unit 40 in a horizontal plane through 360 degrees to determine the azimuth at which signal strength is maximized. This then indicates the direction to transmitter 10, while the overall signal strength indicated by LCD 41, as a percentage of maximum, indicates distance. Many times, this may be all that is necessary to identify visually target 1 bearing transmitter 10 and allow the operator to proceed in visual mode, perhaps calling out to target 1 (e.g. a person or pet) or tracking down target 1 hidden within clothing or other materials (e.g. merchandise in the process of being stolen).

The present invention, described in either its preferred or alternate embodiment, thus provides means for monitoring a plurality of targets 1 by attaching to them relatively inexpensive transmitter 10 and monitoring them by similarly economical base unit 40. Tour operators can issue transmitters to every member of a group and check to assure that all are on board a bus or boat prior to leaving the immediate area. Base unit 40 can be programmed to provide a head count and to compare that to the expected head count, sounding an alarm if they are not the same, and further identifying the transmitters not reporting.

While the invention has been particularly shown and described with reference to one or more embodiments, it will be understood by those skilled in the art that various changes in form and detail may be made therein without departing from the spirit and scope of the invention. For example, specific hardware has been described for providing base unit 40 capable of monitoring a finite number of transmitters 10 limited by the prime number intervals of Chart A, but other equipment could increase or decrease the practical population of transmitters 10.

I claim:

1. A monitoring system for movable targets comprising a plurality of target-borne transmitters, each transmitter having a case;

attachment means for attaching the case to the target;

a radio-frequency signal generator housed within the case and adapted to generate and repeatedly to transmit a coded signal at a selected radio frequency and separated by a selected prime number time interval;

a transmitter antenna coupled to the signal generator; and a battery within the case and coupled to signal generator; and a base unit adapted to monitor the transmitters, the base unit having a housing having an interior and a face;

signal detection means within the housing for listening at the selected frequency and prime number time interval for each transmitter; and receiving the coded signals from the transmitter signal generator transmitting at its selected prime number time interval;

a database within the housing and containing information about each target and the transmitter's selected prime number time interval;

processing means within the housing and adapted to detect coded signals from the signal detection means;

process the coded signals to update the database means with information about the transmitter attached to each target; and sound an alarm for an out-of-range condition of any transmitter;

operator interface means for providing an operator with control of the processor means and information about each target; and power means for providing power to the base unit.

2. The monitoring system according to claim 1 wherein the attachment means further comprises disconnect loop means surrounding at least a portion of the target for detecting a disconnection of the transmitter from the target; and the signal generator initiates an alarm status within the coded signal if the transmitter becomes disconnected from the target.

3. The monitoring system according to claim 2 wherein the disconnect loop means comprises
the transmitter antenna.

4. The monitoring system according to claim 1 wherein the signal detection means comprises
a radio-frequency receiver within the housing and coupled to the processing means; and
an antenna system having
an omnidirectional antenna and a directional antenna; and
antenna selection means for selectively coupling the omnidirectional antenna and the directional antenna to the signal detection means.

5. The monitoring system according to claim 4 wherein the antenna selection means comprises
a three-way switch on the operator interface means and coupled between both of the antennas and the processing means.

6. The monitoring system according to claim 1 wherein the operator interface means comprises
an antenna selection switch;
an acknowledge button adapted to initiate a transmitter alarm acknowledgment routine;
an find button adapted to activate a transmitter search routine; and
a liquid crystal diode disposed on the face and adapted to display information from the processing means.

7. The monitoring system according to claim 1 wherein the power means comprises
a battery.

8. The monitoring system according to claim 1 wherein the processing means comprises
a microprocessor coupled to the signal detection means and the database and adapted to
separate the coded signal into individual bytes;
analyze at least one of the coded signal bytes to identify each transmitter and to compare it to the information in the database;
analyze at least one of the coded signal bytes to identify the base unit to which the transmitter is signaling;
analyze a third byte to determine distance and direction of the transmitter from the base unit; and
detect and correct errors in the coded signal.

9. The monitoring system according to claim 1 wherein the coded signal further comprises
a digital word having
a transmitter identifier byte;
at least one base unit identifier byte;
an error detection and correction byte; and
a signal strength byte.

10. The monitoring system according to claim 9 wherein
the signal strength byte is fixed at maximum value.

11. The monitoring system according to claim 9 and further comprising
a low battery condition code.

12. A remote target monitoring system comprising
a transmitter for each target, the transmitter having
a signal generator coupled to a transmitter antenna and adapted to generate a coded signal through the transmitter, the coded signal containing at least one digital word having
a transmitter identifier byte;
at least one base unit identifier byte;
an error detection and correction byte; and
a signal strength byte; and
an attachment coupling the transmitter to the target; and
a base unit adapted to monitor a plurality of transmitters, the base unit having
a coded signal detector adapted to detect each transmitter's coded signal using its transmitter identifier byte and its at least one base unit identifier byte;
a signal processor coupled to the detector and adapted to analyze the transmitter coded signals to;
determine a status of each transmitter using its coded signal error detection and correction byte;
determine a direction and distance of each transmitter from the base unit by using its signal strength byte;
store status information about each transmitter into a database;
detect an out of range condition for any active transmitter from its signal strength byte;and
activate an alarm for any transmitter having an out of range condition; and
a user interface coupled to the signal processor and adapted to display information about each target and transmitter to an operator.

13. The monitoring system according to claim 12 wherein the user interface further comprises
an antenna selector coupled to the signal detector and adapted to selectively couple one of an omnidirectional antenna and a directional antenna to the signal processor;
a liquid crystal display coupled to the signal processor and adapted to selectively display numeric and signal strength data;
an alarm acknowledgment switch; and
a search activation switch.

14. The monitoring system according to claim 12 wherein the signal detector further comprises
a radio-frequency receiver within the housing and coupled to the signal processor; and
an antenna system having
an omnidirectional antenna and a directional antenna; and
an antenna selector coupled to the signal detector and adapted to selectively couple one of the omnidirectional antenna and the directional antenna to the signal processor.

15. The monitoring system according to claim 12 wherein the signal processor is programmed to
separate the coded signal into individual bytes;
analyze the error detection and correction byte to assure that the coded signal may be analyzed;
analyze transmitter byte to identify the transmitter and associate the coded signal with information in the database about the target to which the transmitter is attached;
analyze the at least one base identifier byte to confirm that the transmitter is transmitting to the base unit; and
analyze the signal strength byte to determine distance and direction of the transmitter from the base unit.

16. An improved method of monitoring a plurality of movable items, the method comprising
providing
a plurality of transmitters, one each coupled to one of the movable items, the
transmitter having a case containing
a signal generator coupled to an antenna;
a potentiometer coupled to the signal generator and adapted to control the strength of the signal; and
a battery powering the signal generator; and
a base unit adapted to monitor a plurality of transmitters, the base unit having signal detection means for detecting signals;

signal processing means coupled to the signal detection means for analyzing the signals to;

determine an active status of each transmitter;

determine a direction and distance of each transmitter from the base unit;

store status information about each transmitter into a database;

detect an out of range condition for any active transmitter;

activate an alarm for any transmitter having an out of range condition; and user interface means for providing a user with information about the items and transmitters; then coupling a transmitter to each movable item; then activating the transmitter to begin transmitting coded signals; then setting the signal processing means to active status for each transmitter coupled to a movable item; then monitoring each transmitter in turn to observe if it has an out of range condition; then searching for any transmitter having an out of range condition with the base unit.

17. The improved method of claim 16 wherein the signal detection means comprises a radio-frequency receiver coupled to the signal processing means;

an antenna system coupled to the receiver and having an omnidirectional antenna;

a directional antenna; and antenna selection means for alternately coupling the omnidirectional antenna and the directional antenna to the receiver.

18. The improved method of claim 17 wherein the searching step further comprises switching antenna system to couple the directional antenna to the receiver; then inspecting the user interface means to confirm that the out-of-range transmitter can be detected; then rotating the base unit in a horizontal plane while monitoring the user interface means to determine the direction of greatest signal strength for the out-of-range transmitter; then comparing the signal strength to a maximum signal strength to determine distance to the out of range transmitter; then proceeding in the direction of greatest signal strength to approach the out-of-range transmitter.

19. The improved method of claim 16 wherein the activating step further comprises adjusting the potentiometer to define a radial distance from the base unit that the movable item will be able to move without triggering an alarm; and interrogating a prime-number generator to select a prime number interval at which to transmit the coded signals at the selected radio frequency.

20. A monitoring system for movable targets comprising a plurality of target-borne transmitters, each transmitter having a case;

attachment means for attaching the case to the target;

signal generating means within the case for generating a coded signal;

a transmitter antenna coupled to the signal generating means; and a battery within the case and coupled to signal generating means; and a base unit adapted to monitor the transmitters, the base unit having a housing having an interior and a face bearing an operator interface;

power means for providing power to the base unit;

signal detection means within the housing for receiving the coded signals;

a database containing information about each transmitter; and a microprocessor within the housing and coupled to the signal detection means and the database, the microprocessor being adapted to detect coded signals from the signal detection means;

detect and correct errors in the coded signal;

analyze coded signal to identify each transmitter;

compare the transmitter to the information in the database;

identify the base unit to which the transmitter is signaling;

determine distance and direction of the transmitter from the base unit, update the database means with information about the transmitter; and sound an alarm for an out-of-range condition of any transmitter.

21. A monitoring system for movable targets comprising a plurality of target-borne transmitters, each transmitter having a case;

attachment means for attaching the case to the target;

signal generating means within the case for generating a coded signal having a transmitter identifier;

at least one base unit identifier;

error detection and correction means; and a signal strength identifier;

a transmitter antenna coupled to the signal generating means; and a battery within the case and coupled to signal generating means; and a base unit adapted to monitor the transmitters, the base unit having a housing having an interior and a face;

signal detection means within the housing for receiving the coded signals;

database means within the housing and containing information about each target;

processing means within the housing and adapted to detect coded signals from the signal detection means;

process the coded signals to update the database means with information about the transmitter attached to each target; and sound an alarm for an out-of-range condition of any transmitter;

operator interface means for providing an operator with control of the processor means and information about each target; and power means for providing power to the base unit.

22. A remote target monitoring system comprising a transmitter for each target, the transmitter having a signal generator coupled to a transmitter antenna and adapted to generate a coded signal containing a digital word having a transmitter identifier byte, at least one base unit identifier byte, an error detection and correction byte, and a signal strength byte;

a case containing the signal generator; and a battery powering the signal generator;

an attachment coupling the transmitter to the target; and a base unit adapted to monitor a plurality of transmitters, the base unit having a database containing information about each transmitter;

a user interface adapted to display information about each target and transmitter;

a coded signal detector;

a signal processor coupled to the coded signal detector and adapted to analyze each coded signal from the plurality of transmitters to separate the coded signal into individual bytes;

analyze the error detection and correction byte to assure that the coded signal may be analyzed;

analyze the transmitter identifier byte to identify the transmitter and associate its coded signal with information in the database about the target to which the transmitter is attached;

analyze the at least one base identifier byte to confirm that the transmitter is transmitting to the base unit;

analyze the signal strength byte to determine distance and direction of the transmitter from the base unit store status information about each transmitter into the database;

detect any out of range condition for the transmitter; and activate an alarm for any transmitter having an out of range condition.

* * * * *